US005342741A

United States Patent [19]

Morimoto et al.

[11] Patent Number: 5,342,741

[45] Date of Patent: Aug. 30, 1994

[54] METHOD OF PROCESSING SILVER HALIDE PHOTOGRAPHIC MATERIAL AND COMPOSITION FOR PROCESSING

[75] Inventors: Kiyoshi Morimoto; Shin-ichi Morishima; Hiroshi Hayakawa, all of Kanagawa, Japan

[73] Assignee: Fuji Photo Film Co., Ltd., Kanagawa, Japan

[21] Appl. No.: 87,886

[22] Filed: Jul. 9, 1993

[30] Foreign Application Priority Data

Jul. 10, 1992 [JP] Japan ..... 4-206281

[51] Int. Cl.[5] ..... G03C 5/29

[52] U.S. Cl. ..... 430/490; 430/434; 430/446; 430/464; 430/486

[58] Field of Search ..... 430/401, 434, 438, 445, 430/446, 464, 481, 482, 486, 490

[56] References Cited

U.S. PATENT DOCUMENTS

| | | | |
|---|---|---|---|
| 3,512,981 | 5/1970 | Prchal et al. | 430/265 |
| 3,664,835 | 5/1972 | Youngquist | 430/435 |
| 3,870,479 | 3/1975 | Kubotera et al. | 430/204 |
| 3,876,427 | 4/1975 | Okutsu et al. | 430/490 |
| 4,264,716 | 4/1981 | Vincent et al. | 430/490 |
| 5,064,751 | 11/1991 | Ohki et al. | 430/490 |
| 5,217,842 | 6/1993 | Kojima et al. | 430/434 |
| 5,254,436 | 10/1993 | Koga et al. | 430/264 |

FOREIGN PATENT DOCUMENTS

| | | |
|---|---|---|
| 1266533 | 3/1972 | United Kingdom . |
| 1326495 | 8/1973 | United Kingdom . |

*Primary Examiner*—Hoa Van Le

*Attorney, Agent, or Firm*—Sughrue, Mion, Zinn, Macpeak & Seas

[57] ABSTRACT

A developer composition having improved stability to aerial oxidation, which contains at least one compound represented by formulae (A) and (B):

(A)

where $R_1$ and $R_2$ each represent a hydroxyl group, an amino group, an acylamino group, an alkylsulfonylamino group, an arylsulfonylamino group, an alkoxycarbonylamino group, a mercapto group or an alkylthio group; and X represents a group of atoms selected from carbon and nitrogen which forms a 5-membered or 6-membered ring together with the two vinyl carbons substituted by $R_1$ and $R_2$, respectively, and the carbonyl carbon of formula (A);

(B)

where $R_3$ and $R_4$ each represent a hydroxyl group, an amino group, an acylamino group, an alkylsulfonylamino group, an arylsulfonylamino group, an alkoxycarbonylamino group, a mercapto group or an alkylthio group; and Y represents a group of atoms selected from carbon, nitrogen and oxygen containing at least one ether bond, and Y forms a 6-membered ring together with the two vinyl carbons substituted by $R_3$ and $R_4$, respectively, and the carbonyl carbon of formula (B), provided that both $R_3$ and $R_4$ are not hydroxyl.

12 Claims, No Drawings

METHOD OF PROCESSING SILVER HALIDE PHOTOGRAPHIC MATERIAL AND COMPOSITION FOR PROCESSING

FIELD OF THE INVENTION

The present invention relates to a method of processing a silver halide photographic material and, in particular, to a processing method having excellent stability, and a composition for processing a silver halide photographic material.

BACKGROUND OF THE INVENTION

Silver halide photographic materials are broadly utilized in various fields of, for example, photoengraving processing and medical diagnosis. With widening application of these materials, the demand for development and processing for photographic image formation is increasing and, in particular, rapid and stable development of photographic materials is strongly desired.

After exposure, a silver halide photographic material is generally processed by processing steps including development, fixation and rinsing with water. A black-and-white developer for the process is generally an alkaline solution containing a hydroquinone compound as a developing agent, an aminophenol or 3-pyrazolidone compound as an auxiliary developing agent and sulfite ions.

The sulfite ions are used in the form of a sulfite or bisulfite of an alkali metal, and it has been an indispensable component for maintaining the developing activity of hydroquinone compounds and for inhibiting aerial oxidation of the developer. In addition, since the sulfite ions have an activity of suitably dissolving silver halides, it is often used for improving the graininess of photographic materials by positively utilizing its action of solution physical development in the development reaction step.

On the other hand, a developer having a higher stability (preservability) is desired. A developer that is stable over a long period of time to aerial oxidation requires less labor for its maintenance and charging to the processing system, and reliably provides constant photographic performance. In particular, where the developer composition is to be constantly maintained and controlled in an automatic developing machine with a predetermined amount of a replenisher being added thereto, the stability of the developer is important for reducing the amount of the replenisher and operational cost. In order to reduce the amount of the replenisher, the stability of the developer must be improved. This is because reduction in the amount of the replenisher correspondingly increases the residence time of the developer in an automatic developing machine and also in the replenisher tank, to thereby expose the developer to a greater degree of aerial oxidation.

Aerial oxidation of a developer may be prevented by increasing the sulfite concentration of the developer, but there is a limit to increasing the sulfite concentration, The reasons are as follows. First, in general, a concentrated developer stock is diluted before use for actual development, and an important factor in adjusting the concentration of the concentrated developer stock is the sulfite content. If a large amount of a sulfite is added to a developer so as to elevate stability of the same, the concentration of the developer stock must be concurrently reduced. In an extreme case, the concentration of the initially prepared developer stock is the same as that of the developer actually used in an automatic developing machine. In other words, the volume of the developer stock is the same as that of the latter developer for actual use in the machine. This result is disadvantageous in view of the transportation cost and the space for the developer. Second, because a developer containing a large amount of a sulfite dissolve much of the silver halide of the silver halide photographic material being processed, the dissolved silver tends to stain the development racks and rollers.

Because of these reasons, incorporation of sulfite in large quality into a developer is limitative, although the sulfite effectively stabilize the developer. Therefore, there is a need for further improvement of the stability and preservability of a developer.

Ascorbic acid is known as a chemical additive capable of improving the preservability of a developer. For example, JP-B 44-28673 (the term "JP-B" as used herein means an "examined Japanese patent publication") describes a known technique of adding ascorbic acid to a lith developer. However, ascorbic acid involves some drawbacks. A deteriorated ascorbic acid in a developer lowers the pH value of the developer, and ascorbic acid is easily decomposed in a developer especially in the presence of a metal ion such as copper ion or iron ion.

The use of ascorbic acid derivatives is also known. Other examples of the use of ascorbic acid derivatives in this technical include U.S. Pat. No. 2,688,549 and JP-B 36-17599 which describe use of ascorbic acid for activation of development and improvement of gradation, and also as a preservative for 3-pyrazolidones. In fact, ascorbic acid has been found to be effective in preventing aerial oxidation of a developer. However, use the compound disadvantageously involves lowering the pH value of a developer, which in turn lowers the developing activity thereof.

SUMMARY OF THE INVENTION

A first object of the present invention is to elevate the stability of a concentrated developer stock, while maintaining the degree of the concentration thereof. A second object is to elevate the stability to aerial oxidation of a developer without promoting silver staining. A third object is to reduce the amount of a replenisher to a developer by elevating the stability of the same, to thereby reduce the load of environmental pollution load of development and to reduce operating costs.

The above objects have been attained by a method of processing an imagewise exposed silver halide photographic material where an exposed silver halide photographic material is developed with a developer containing at least one compound of general formulae (A) and (B):

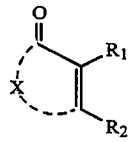

(A)

where $R_1$ and $R_2$ each represent a hydroxyl group, an amino group, an acylamino group, an alkylsulfonylamino group, an arylsulfonylamino group, an alkoxycarbonylamino group, a mercapto group or an alkylthio group; and X represents a group of atoms selected from carbon and nitrogen which forms a 5-membered or 6-membered ring together with the two vinyl carbons of formula (A) substituted by $R_1$ and $R_2$, respectively, and the carbon atom of the carbonyl group;

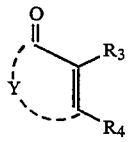

(B)

where $R_3$ and $R_4$ each represent a hydroxyl group, an amino group, an acylamino group, an alkylsulfonylamino group, an arylsulfonylamino group, an alkoxycarbonylamino group, a mercapto group or an alkylthio group; and Y represents a group of atoms selected from carbon, nitrogen and oxygen, Y contains at least one

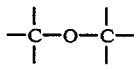

bond, and Y forms a 5-membered or 6-membered ring together with the two vinyl carbons of formula (B) substituted by $R_3$ and $R_4$, respectively, and the carbon atom of the carbonyl group provided that both $R_3$ and $R_4$ are not hydroxyl at the same time.

DETAILED DESCRIPTION OF THE INVENTION

Compounds of formula (A) are described in detail below.

In formula (A), $R_1$ and $R_2$ each represent a hydroxyl group, an amino group preferably having 0 to 20 carbon atoms (which may be substituted, for example, by one or two alkyl group(s) each having from 1 to 10 carbon atoms, such as methyl, ethyl, n-butyl; the alkyl group may be substituted, for example, by a hydroxyl group, —$S_3M$ or —COOM (wherein M represents a hydrogen atom, an alkali metal atom such as Li, Na and K, and —$NH_4$) to form, for example, hydroxyethyl), an acylamino group including an aliphatic- and aromatic-acylamino group, preferably having 2 to 20 carbon atoms (e.g., acetylamino, benzoylamino), an alkylsulfonylamino group preferably having 1 to 20 carbon atoms (e.g., methanesulfonylamino), an arylsulfonylamino group preferably having 6 to 20 carbon atoms (e.g., benzenesulfonylamino, p-toluenesulfonylamino), an alkoxycarbonylamino group preferably having 2 to 20 carbon atoms (e.g., methoxycarbonylamino), a mercapto group, or an alkylthio group preferably having 1 to 20 carbon atoms (e.g., methylthio, ethylthio). In the present invention the carbon atom number includes the number of carbon atoms in the substituent(s). Preferred examples of $R_1$ and $R_2$ include a hydroxyl group, an amino group, an alkylsulfonylamino group and an arylsulfonylamino group. X is composed of a group of atoms selected from carbon atoms and nitrogen atoms, and forms a 5-membered or 6-membered ring along with the two vinyl carbons substituted by $R_1$ and $R_2$, respectively, and the one carbonyl carbon as shown in formula (A). For example, X is composed of two or three of —$C(R_5)(R_6)$—, —$C(R_7)$=, —C(=O)—, —$N(R_8)$— and —N=. $R_5$, $R_6$, $R_7$ and $R_8$ each represent a hydrogen atom, a substituted or unsubstituted alkyl group having from 1 to 10 carbon atoms (substituents of the substituted alkyl group, for example, include a hydroxyl group, —COOM, or —$SO_3M$ (M has the same meaning as defined hereinabove), a substituted or unsubstituted aryl group having from 6 to 15 carbon atoms (substituents of the substituted aryl group, for example, include an alkyl group, a halogen atom, a hydroxyl group, —COOM, or —$SO_3M$ (M has the same meaning as defined hereinabove)), a hydroxyl group, —COOM, or —$SO_3M$ (M has the same meaning as defined hereinabove). The 5-membered or 6-membered ring may be condensed with saturated or unsaturated ring(s) preferably a 5- or 6-membered hydrocarbon ring to form a condensed ring. Examples of the 5-membered or 6-membered ring include a cyclopentenone ring, a cyclohexenone ring, a pyrrolinone ring, a pyrazolinone ring, a pyridone ring, an azacyclohexenone ring and a uracil ring. Preferred examples of the ring are a cyclopentenone ring, a cyclohexenone ring, a pyrazolinone ring, an azacyclohexenone ring and an uracil ring.

Compounds of formula (B) are described in detail below.

In formula (B), $R_3$ and $R_4$ each has the same carbon number as those corresponding groups represented by $R_1$ and $R_2$ and each represent a hydroxyl group, an amino group (which may be substituted, for example, by one or two alkyl group(s) each having from 1 to 10 carbon atoms, such as methyl, ethyl, n-butyl; the alkyl group may be substituted, for example, by a hydroxyl group, —$SO_3M$ or —COOM (wherein M represents a hydrogen atom, an alkali metal atom such as Li, Na and K, and —$NH_4$) to form, for example, or hydroxyethyl), an acylamino group including an aliphatic- and aromatic-acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), an alkoxycarbonylamino group (e.g., methoxycarbonylamino), a mercapto group, or an alkylthio group (e.g., methylthio, ethylthio) . Preferred examples of $R_3$ and $R_4$ include a hydroxyl group, an amino group, an alkylsulfonylamino group and an arylsulfonylamino group. $R_3$ and $R_4$ cannot both represent hydroxyl groups. Y is composed of atoms selected from carbon atoms, nitrogen atoms and oxygen atoms and Y contains at least one

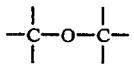

bond. Y forms a 5-membered or 6-membered ring together with the two vinyl carbons substituted by $R_3$ and $R_4$, respectively, and the one carbonyl carbon as shown in formula (B). For example, Y is composed of one or two of —$C(R_5)(R_6)$—, —$C(R_7)$=, —C(=O)—, —$N(R_8)$— and —N=, further contains at least one —O—. $R_5$, $R_6$, $R_7$ and $R_8$ each represent a hydrogen atom, a substituted or unsubstituted alkyl group having from 1 to 10 carbon atoms (substituents of the substituted alkyl group, for example, include a hydroxyl group, —COOM, —$SO_3M$ (M has the same meaning as defined hereinabove), a substituted or unsubstituted aryl group having from 6 to 15 carbon atoms (substituents of the substituted aryl group, for example, include an alkyl group, a halogen atom, a hydroxyl group, —COOM, —$SO_3M$ (M has the same meaning as defined hereinabove)), a hydroxyl group, —COOM, —$SO_3M$ (M has the same meaning as defined hereinabove) or an alkoxycarbonyl group. The 5-membered or 6-membered ring may be condensed with saturated or unsaturated ring(s) (preferably a 5- or 6- membered hydrocarbon ring) to form a condensed ring. Examples of the 5-membered or 6-membered ring include a dihydrofuranone ring, a dihydropyrrone ring and a pyranone ring. Preferred examples of the ring are a dihydrofuranone ring and a dihydropyrrone ring.

When compounds represented by formulae (A) and (B) has an amino group, the compounds may be in the form of an addition salt with an organic acid (e.g., acetic acid) or an inorganic acid (e.g., HCl).

Specific examples of compounds of formulae (A) and (B) for use in the present invention are described below, which, however, are not limitative.

A-1

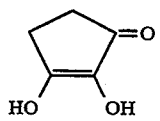

A-2

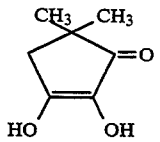

A-3

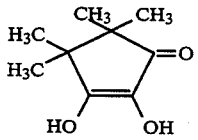

A-4

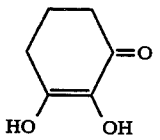

A-5

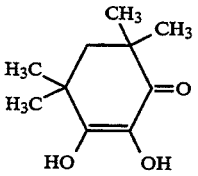

A-6

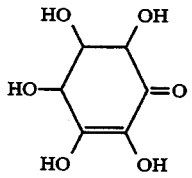

A-7

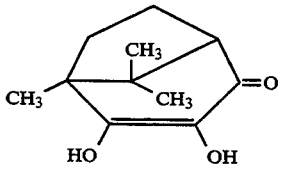

-continued

A-8

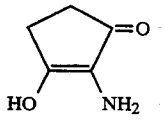

A-9

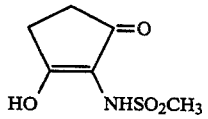

A-10

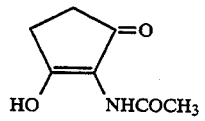

A-11

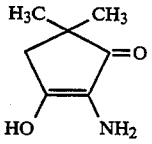

A-12

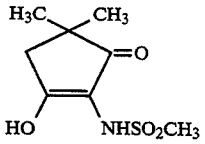

A-13

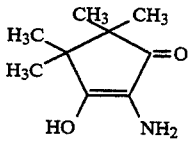

A-14

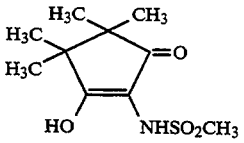

A-15

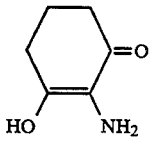

A-16

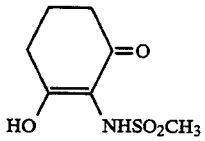

A-17

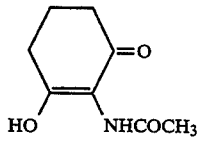

A-18

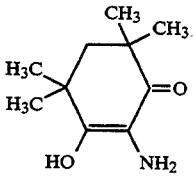

-continued
A-19
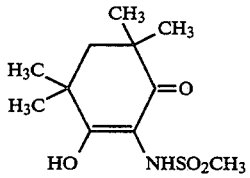
A-20
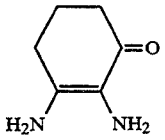
A-21
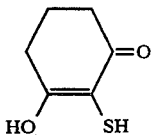
A-22
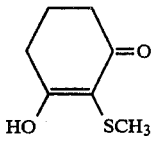
A-23
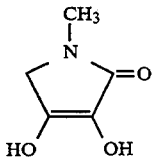
A-24
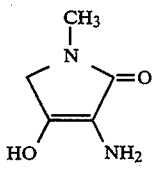
A-25
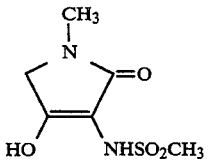
A-26
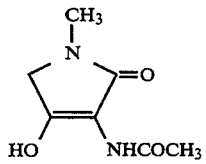
A-27
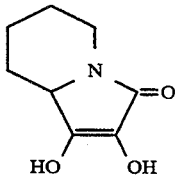
-continued
A-28
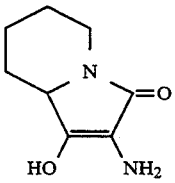
A-29
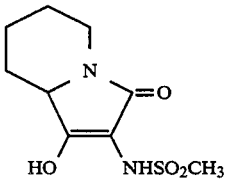
A-30
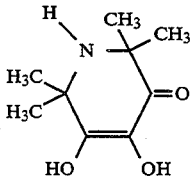
A-31
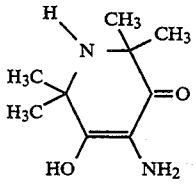
A-32
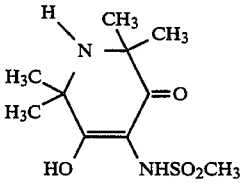
A-33
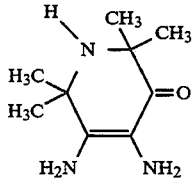
A-34
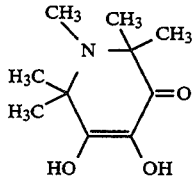
A-35
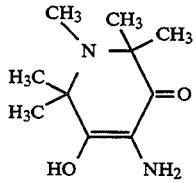

-continued
A-36
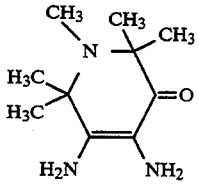
A-37
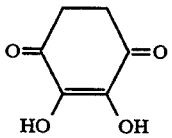
A-38
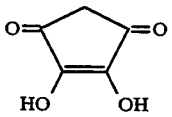
A-39
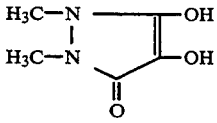
A-40
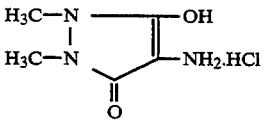
A-41
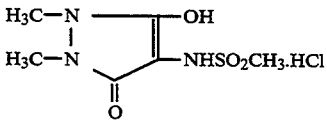
A-42
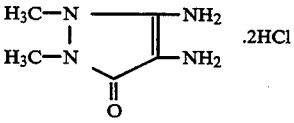
A-43
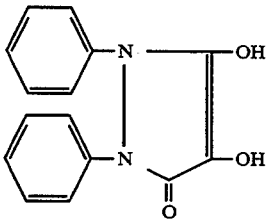
A-44
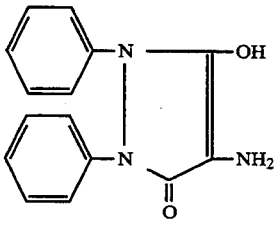
-continued
A-45
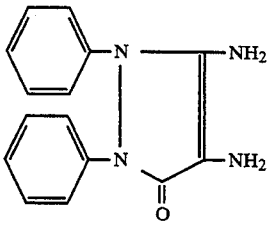
A-46
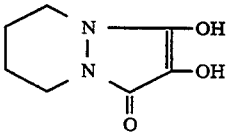
A-47
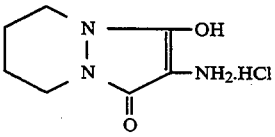
A-48
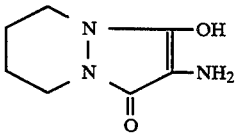
A-49
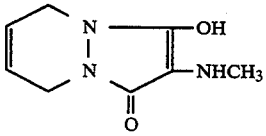
A-50
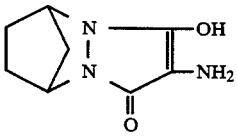
A-51
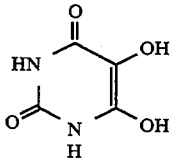
A-52
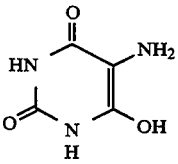
A-53
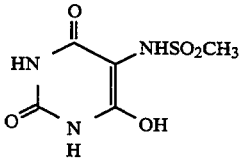

-continued
A-54
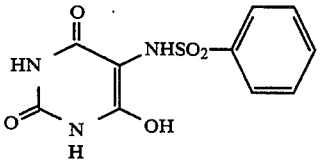
A-55
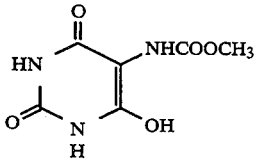
A-56
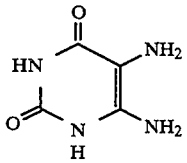
A-57
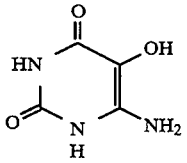
A-58
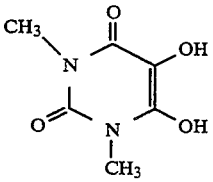
A-59
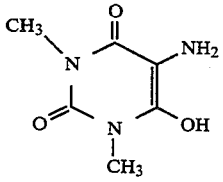
A-60
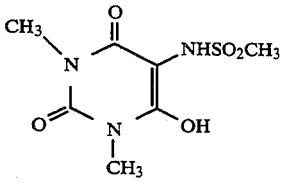
A-61
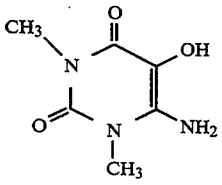
A-62
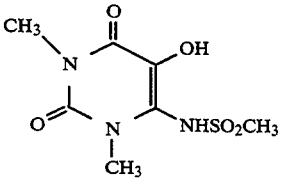
-continued
A-63
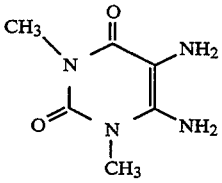
A-64
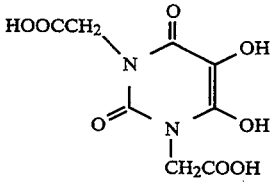
A-65
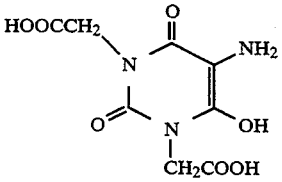
A-66
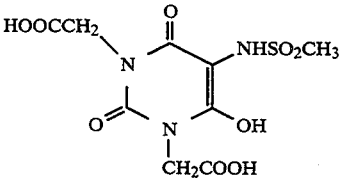
A-67
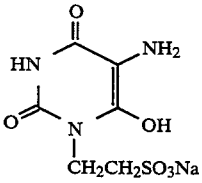
A-68
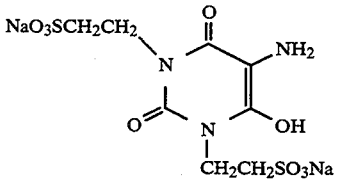
A-69
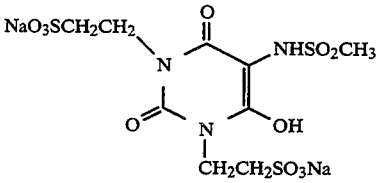
B-1
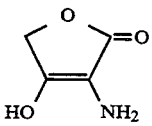
B-2
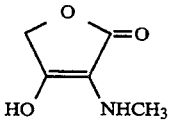

-continued
B-3
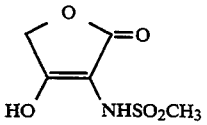
B-4
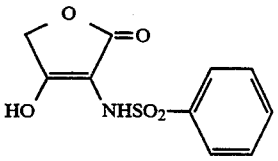
B-5
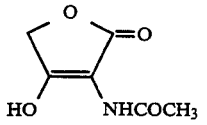
B-6
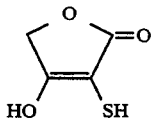
B-7
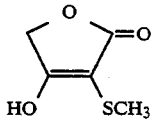
B-8
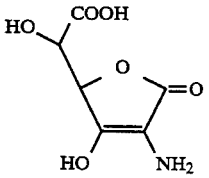
B-9
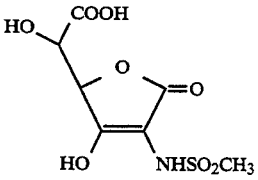
B-10
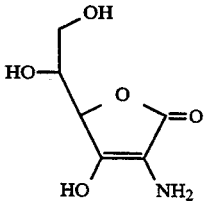
B-11
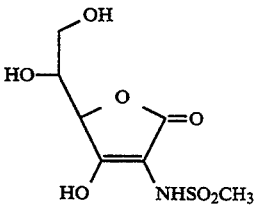
-continued
B-12
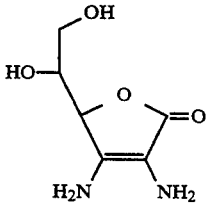
B-13
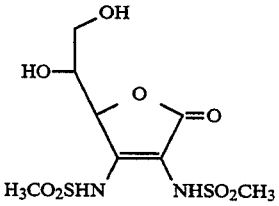
B-14
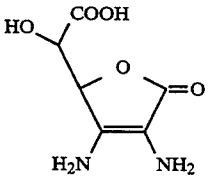
B-15
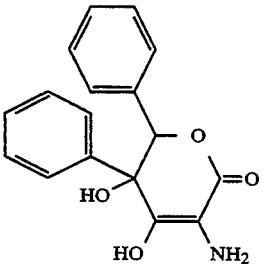
B-16
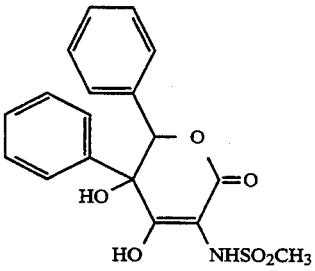
B-17
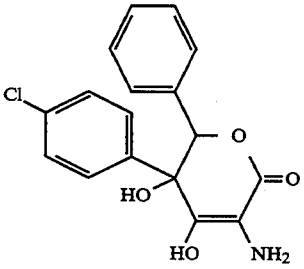

-continued
B-18
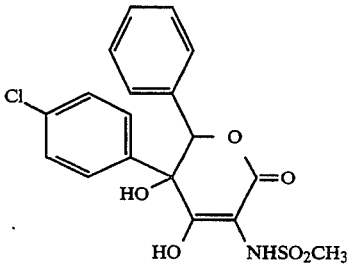
B-19
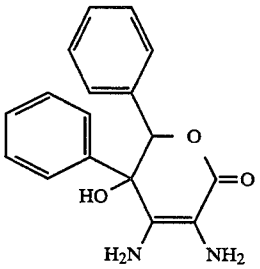
B-20
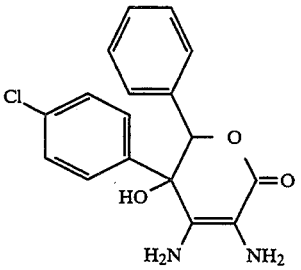
B-21
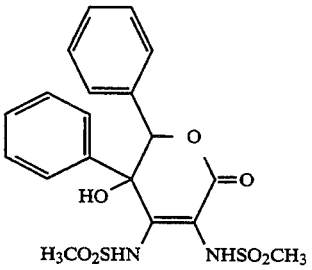
B-22
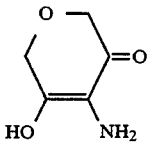
B-23
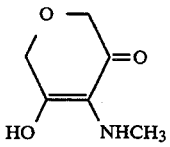
B-24
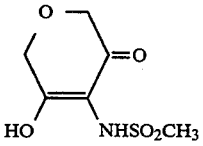
-continued
B-25
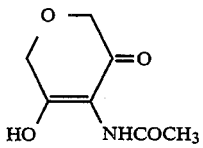
B-26
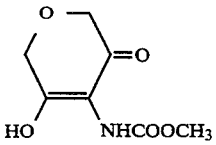
B-27
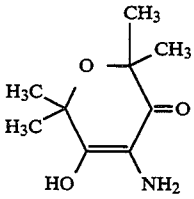
B-28
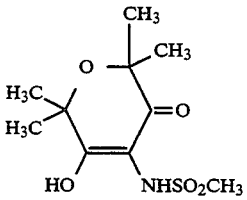
B-29
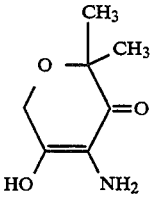
B-30
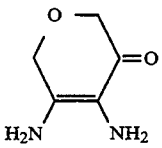
B-31
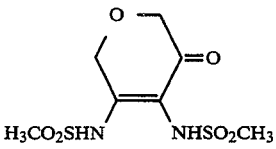
B-32
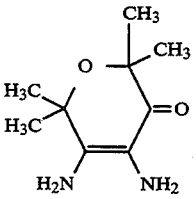
B-33
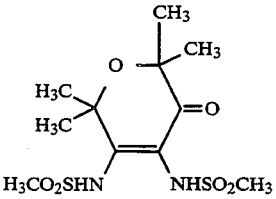

-continued

B-34

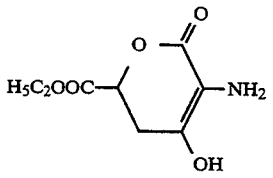

B-35

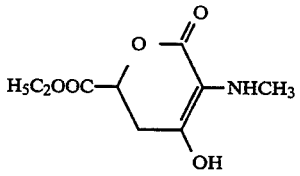

B-36

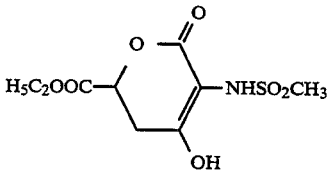

B-37

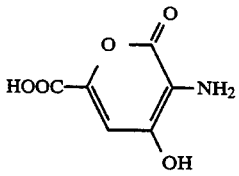

B-38

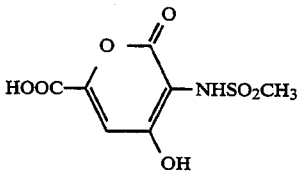

B-39

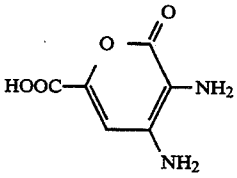

B-40

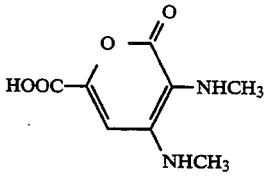

B-41

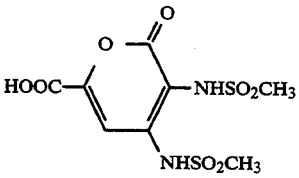

In a concentrated developer stock the total amount of the compounds of formula (A) and (B) may be from 1 to 10 times, preferably from 1 to 5 times, the amount thereof in the developer. When the stock is separated into two or more parts, these compounds may be incorporated into any part.

Compounds of formulae (A) and (B) may be prepared in accordance with general synthesis methods such as those described in G. Hesse, *Methoden der Organischen Chemie*, Vol. 4, 217–298; D. R. Bender, *J. Org. Chem.*, Vol. 40, 1264 (1975); U.S. Pat. No. 4,128,425; A. Stein, *J. Am. Chem. Soc.*, Vol. 78, 6185 (1956).

Compounds of formulae (A) and (B) may be used in combination.

The total amount of the compound(s) of formulae (A) and (B) added to the developer is preferably from 0.1 to 50 g, more preferably from 0.5 to 25 g per liter of the developer.

Examples of a dihydroxybenzene developing agent which may be used in the present invention is, include, for example, hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone and hydroquinone monosulfonate. Of these, especially preferred are hydroquinone and hydroquinone monosulfonate.

The developer may contain a p-aminophenol developing agent selected, for example, from N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. Of these, especially preferred is N-methyl-p-aminophenol.

The developer may further contain a 3-pyrazolidone developing agent selected, for example, from 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3pyrazolidone, 1-p-aminophenyl-4,4-dimethyl-3-pyrazolidone, 1-(p-tolyl)-4,4-dimethyl-3-pyrazolidone and 1-(p-tolyl)-4-methyl-4-hydroxymethyl-3-pyrazolidone.

The content of the dihydroxybenzene developing agent in the developer is generally from 0.01 mol/liter to 1.5 mol/liter, preferably from 0.05 mol/liter to 1.2 mol/liter.

In addition to the dihydroxy benzene developing agent, the developer may contain a p-aminophenol developing agent and/or a 3-pyrazolidone developing agent generally in an amount of from 0.0005 mol/liter to 0.2 mol/liter, preferably from 0.001 mol/liter to 0.1 mol/liter.

Compounds which form sulfite ions in the developer, such as a sulfite, a bisulfite and a metabisulfite may be used in the present invention. Examples of such compounds include sodium sulfite, potassium sulfite, lithium sulfite, ammonium sulfite, sodium bisulfite and potassium metabisulfite. The content of the sulfite is preferably 0.1 mol/liter or more and more preferably 0.3 mol/liter or more, and not more than 2.0 mol/liter. The upper limit of the compound in a concentrated developer stock preferably does not exceed 20 mol/liter.

The developer for use in the present invention preferably has a pH value ranging from 9 to 13, more preferably from 9.3 to 12.

For adjustment of the pH value of the developer, an alkali agent may be employed as a pH adjusting agent, including, for example, sodium hydroxide, potassium hydroxide, sodium carbonate, potassium carbonate, sodium tertiary phosphate and potassium tertiary phosphate.

A buffer agent such as borate as disclosed in JP-A-62-186259, saccharose, acetoxime and sulfosalicylic acid as disclosed in JP-A-60-93433 (U.S. Pat. No. 4,569,904), phosphoric acid and a carbonate may be used in the developer of the present invention (the term "JP-A" as used herein means an "unexamined published Japanese patent application").

The developer preferably contains a chelating agent having a chelating stability constant to iron ion of 8 or more.

The chelating stability constant as referred to herein is described in, L. G. Sillen & A. E. Martell, *Stability Constants of Metal-ion Complexes* (by The Chemical Society, London, 1964); and S. Chaberek & A. E. Martell, *Organic Sequestering Agents* (by Wiley, 1959).

The chelating agent having a chelating stability constant to iron ion of 8 or more for use in the present invention includes for example, organic carboxylic acid chelating agents, organic phosphoric acid chelating agents, inorganic phosphoric acid chelating agents and polyhydroxyl compounds. The iron ion as referred to hereinabove is ferric ion ($Fe^{3+}$).

Specific nonlimiting examples of the chelating agent for use in the present invention having a chelating constant to iron ion of 8 or more, the following compounds are mentioned, which, however, are not limitative. They are ethylenediamine-diorthohydroxyphenylacetic acid, triethylenetetramine-hexaacetic acid, diaminopropane-tetraacetic acid, nitrilotriacetic acid, hydroxyethylethylenediamine-triacetic acid, dihydroxyethylglycine, ethylenediamine-diacetic acid, ethylenediamine-dipropionic acid, iminodiacetic acid, diethylenetriamine-pentaacetic acid, hydroxyethylimino-diacetic acid, 1,3-diamino-2-propanol-tetraacetic acid, transcyclohexanediamine-tetraacetic acid, ethylenediamine-tetraacetic acid, glycoletherdiamine-tetraacetic acid, ethylenediamine-N,N,N',N'-tetrakismethylenephosphonic acid, nitrilo-N,N,N-trimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate and sodium hexametaphosphate.

A preferred amount of the chelating agent is 0.1 to 50 g per 1 of the developer.

The developer may contain a dialdehyde hardening agent or its bisulfite adduct. Examples thereof include glutaraldehyde and its bisulfite adduct.

In addition to the above-mentioned components, the developer may further contain a development inhibitor such as sodium bromide, potassium bromide or potassium iodide; an organic solvent such as ethylene glycol, diethylene glycol, triethylene glycol, dimethylformamide, methyl cellosolve, hexylene glycol, ethanol or methanol; and an antifoggant, such as a mercapto compound (e.g., 1-phenyl-5-mercaptotetrazole or sodium 2-mercaptobenzimidazole-5-sulfonate), an indazole compound (e.g., 5-nitroindazole) or a benzotriazole compound (e.g., 5-methylbenzotriazole). The developer may also contain a development accelerator such as those described in *Research Disclosure*, Vol. 176, No. 17643, Item XXI (December, 1978), and optionally a color toning agent, a surfactant, a defoaming agent and a water softener, as needed.

The developer for use in the photographic processing method of the present invention may contain silver stain inhibitors in addition to those represented by formulae (A) and (B) of the present invention, such as the compounds described in JP-A 56-24347, preferably in an amount of not more than 5 g per 1 of the developer.

The developer may contain an amino compound such as the alkanolamines described in European Pat. No. Laid-Open No. 136,582, British Pat. No. 958,678, U.S. Pat. No. 3,232,761 and JP-A 56-106244, for acceleration of development and elevation of contrast, and for other purposes.

In addition, the developer may contain other additives such as those described in L. F. A. Maison, *Photographic Processing Chemistry* (by Focal Press, 1966), pp. 226 to 229; U.S. Pat Nos. 2,193,015 and 2,592,364; and JP-A 48-64933.

The fixer for use in the method of the present invention is an aqueous solution generally containing a thiosulfate, and preferably has pH of 3.8 or more, more preferably from 4.2 to 7.0.

The fixing agent includes, for example, sodium thiosulfate and ammonium thiosulfate. Preferred is ammonium thiosulfate in view of the fixing rate. The amount of the fixing agent in the fixer may be varied as needed, and is generally from 0.1 to 6 mol/liter.

The fixer may contain a water-soluble aluminium salt which acts as a hardening agent. The salt includes, for example, aluminium chloride, aluminium sulfate, potassium alum. The amount of the water-soluble aluminium salt in the fixer is generally from 0.4 to 2.0 g, as aluminium, per liter. The fixer may further contain a tri-valent iron compound as its complex with ethylenediaminetetraacetic acid as an oxidizing agent.

The fixer may contain tartaric acid, citric acid, gluconic acid and their derivatives, singly or in combination of two or more thereof as a fixing accelerator. The content of the compound(s) in the fixer is preferably 0.005 mol/liter or more, especially preferably from 0.01 mol/liter to 0.03 mol/liter.

The fixer may optionally contain a preservative (e.g., sulfites, bisulfites), a pH buffer (e.g., acetic acid, boric acid), a pH adjusting agent (e.g., sulfuric acid), a chelating agent having a water-softening capacity, and the compounds described in JP-A 62-78551.

The "development step time" or "development time" as referred to herein means the time from when the edge of the photographic material is dipped into the tank developer of an automatic developing machine to the time when that same edge is dipped into the next processing bath (e.g., fixing bath) in the processing sequence; the "fixation time" means the time from dipping the photographic material into the fixing solution to dipping of the same into the next processing bath (e.g., a rinsing tank solution or stabilizer); and the "rinsing time" means the time during when the photographic material is dipped into the tank rinsing solution.

The "drying time" as referred to herein means the time while the processed photographic material is in the drying zone of an automatic developing machine. Hot air preferably of from 35° C. to 100° C., more preferably from 40° C. to 80° C. is blown into the drying zone.

In the method of the present invention, the development time is generally from 5 seconds to one minute, preferably from 5 seconds to 30 seconds; and the development temperature is preferably from 25° C. to 50° C., more preferably from 25° C. to 40° C.

The fixation temperature and time are preferably about from 20° C. to 50° C. and from 5 seconds to one minute, more preferably from 25° C. to 40° C. and from 5 seconds to 30 seconds.

The rinsing or stabilization temperature and time are preferably from 0° C. to 50° C. and from 5 seconds to one minute, more preferably from 15° C. to 40° C. and from 5 seconds to 30 seconds.

In accordance with the method of the present invention, the developed, fixed and rinsed (or stabilized) photographic material is squeezed to remove the rinsing solution therefrom with squeeze rollers and then dried. The drying is effected at a temperature of about from 40° C. to 100° C.; and the drying time, although depending on ambient conditions, is generally from about 5 seconds to one minute, more preferably about from 5 seconds to 30 seconds at a drying temperature of from 40° C. to 80° C.

The photographic material to which the method of the present invention is applied is not particularly limited, and may be applied, e.g., to color photographic materials for reversal processing (for example, color reversal films or papers) in addition to general black-and-white photographic materials. In particular, it is especially preferably applied to processing of photographic materials for laser printers and other printing photographic materials as well as to processing of direct X-ray photographic materials for medical use, indirect X-ray photographic materials for medical use, hydrazine nucleating agent-containing high contrast photographic films, CRT image recording photographic materials, micro films, general black-and-white negative films and black-and-white printing papers.

The halogen composition of the silver halide emulsion constituting the photographic material for processing in accordance with the method of the present invention is not particularly limited. The emulsion may comprise anyone of silver chloride, silver iodide, silver bromide, silver chlorobromide, silver iodobromide or silver chloroiodobromide dispersed in a hydrophilic colloid.

The silver halide emulsion may be prepared by methods well known in this technical field (for example, by a single jet method, a double jet method or a controlled jet method) in which a water-soluble silver salt (for example, silver nitrate) and water-soluble halide(s) are blended and emulsified in the presence of water and a hydrophilic colloid. The resulting emulsion is then subjected to physical ripening and chemical ripening such as gold sensitization and/or sulfur sensitization. The shape of the silver halide grains constituting the silver halide emulsion for use in the present invention is not particularly limited. The grains may be any of cubic, octahedral or spherical grains and also tabular grains having a high aspect ratio as described in *Research Disclosure* 22534 (January, 1983).

Emulsions comprising tabular silver halide grains are preferably employed in preparing X-ray photographic materials. In this case, the grains are preferably silver bromide or silver iodobromide grains, more preferably those having a silver iodide content of 10 mol % or less, especially preferably from 0 to 5 mol %, to thereby provide photographic materials having high sensitivity which are well adapted for rapid processing.

The tabular silver halide grains preferably have an aspect ratio of from 4 to 20, more preferably from 5 to less than 10. The thickness of the tabular grains is preferably 0.3 $\mu$ or less, especially preferably 0.2 $\mu$ or less. The aspect ratio of the tabular silver halide grains as referred to herein is a ratio of the mean value of the diameter of a circle having the same area as the projected area of the individual tabular grains to the mean value of the thickness of the individual tabular grains.

The content of the tabular silver halide grains in the tabular silver halide emulsion is preferably 80% by weight or more, more preferably 90% by weight or more, to the total grains in the emulsion.

The photographic stability in continuous (running) processing in accordance with the present invention may be enhanced by processing a photographic material containing such tabular grains. In addition, the silver amount contained in the photographic material may be reduced so that the load in the fixation step and the drying step is correspondingly reduced to promote rapid processing.

The tabular silver halide emulsions for use in this invention are described, for example, in Cugnac and Chateau, *Evolution of the Morphology of Silver Bromide Crystals during Physical Ripening* (by Science et Industrie Photographie), Vol. 33, No. 2 (1962), pp. 121–125; Duffin, *Photographic Emulsion Chemistry* (by Focal Press, New York, 1966), pp. 66–72; and A. P. H. Tribvlli & W. F. Smith, *Photographic Journal*, Vol. 80, p. 285 (1940). The tabular grains are readily prepared, for example, with reference to the methods described in JP-A 58-127921, 58-113927 and 58-113928.

For example, for preparing a tabular silver halide emulsion, seed crystals containing tabular grains in an amount of 40% by weight or more can be formed in a reaction system having a relatively low pBr value, for example, of 1.3 or less. A silver salt solution and halide solution(s) are then simultaneously added thereto at a pBr value of the same degree to grow the seed crystals.

During the step of growing the grains, addition of the silver salt solution and halide solution(s) is desirably effected in such manner that new crystal nuclei are not formed.

The grain size of the tabular silver halide grains may be varied by appropriately adjusting the reaction temperature, suitable selection of the kind and amount of the silver halide solvent used, and suitable control of the addition speed of the silver salt solution and halide solution(s) added during growth of the grains.

The silver halide emulsion for use in the present invention may be either a polydispersed emulsion or a monodispersed emulsion having a narrow grain size distribution. In particular, a printing photographic material for processing in accordance with the method of the present invention preferably comprises a monodispersed emulsion(s) having a grain size distribution of 20% or less. The monodispersed emulsion referred to herein is a silver halide emulsion having, as its grain size distribution, a fluctuation coefficient of 20% or less, especially 15% or less.

The fluctuation coefficient as referred to herein is defined as follows:

$$\text{Fluctuation Coefficient (\%)} = [(\text{standard deviation of individual grain sizes})/(\text{mean grain size})] \times 100$$

The inner and surface layer of the silver halide grains may comprise an uniform phase or may comprise different phases. Two or more separately prepared silver halide emulsions may be blended for use in the present invention.

The silver halide grains may be of the type which form a latent image substantially on the surface of the grain, or of the type which form a latent image substantially in the inside of the grain. Furthermore, previously surface-fogged silver halide grains may also be employed in the present invention.

During forming or physical ripening of the silver halide emulsions for use in the present invention, a cadmium salt, a sulfite, a lead salt, a thallium salt, a rhodium salt, its complex salt, an iridium salt and/or its complex salt may be added to the reaction system. In particular, for the purpose of increasing hard contrast or improving reciprocity law failure characteristic, preparation of silver halide grains in the presence of an iridium salt in an amount of from $10^{-8}$ to $10^{-3}$ mol per mol of silver halide, is preferred.

The silver halide emulsion for use in the present invention may contain at least one of iron compounds, rhenium compounds, ruthenium compounds and osmium compounds. The addition amount of these compound(s) is $10^{-3}$ mol or less, preferably from $10^{-6}$ to $10^{-4}$ mol, per mol of silver.

The emulsion may or may not be chemically sensitized. For chemical sensitization, known methods, for example, of sulfur sensitization, reduction sensitization and gold sensitization may be employed singly or in combination. Sulfur sensitization is preferred.

A sulfur sensitizing agent may be employed for sulfur sensitization, including, for example, sulfur compounds contained in gelatin, as well as various other sulfur compounds such as thiosulfates, thioureas, thiazoles and rhodanines. Specific examples thereof are described, for example, in U.S. Pat. Nos. 1,574,944, 2,278,947, 2,410,689, 2,728,668, 3,501,313 and 3,656,955. Preferred sulfur compounds are thiosulfates and thioureas. The pAg value during chemical sensitization is preferably 8.3 or less, more preferably from 7.3 to 8.0.

The method of employing a polyvinyl pyrrolidone and a thiosulfate, as reported by Moisar, Klein et al., in *Gelatione. Proc. Symp.*, 2nd, 301–309 (1970), provides a preferable result.

Gold sensitization using a gold compound is typical of noble metal sensitization, and the gold compound is generally a gold complex. The sensitization method may employ noble metal complex(es) other than a gold complex, such as platinum, palladium, iridium or the like complex(es) . Specific examples of useful noble metal complexes are described, for example, in U.S. Pat. No. 2,448,060 and British Pat. 618,061. In addition, also useful in the present invention is sulfur sensitization using sulfur-containing compounds, selenium sensitization using selenium sensitizing agents, tellurium sensitization using tellurium sensitizing agents or reduction sensitization using complex salts or polyamines, or combination of two or more thereof.

Useful reduction-sensitizing agents include, for example, stannous salts, amines, sulfinoformamidines, dialkylaminoborans and silane compounds; and specific examples thereof are described, for example, in U.S. Pat. Nos. 2,487,850, 2,518,698, 2,983,609, 2,983,610 and 2,694,637.

The swelling percentage as referred to herein is obtained, as a percentage of the increase in the thickness of the layers constituting a photographic material, by a method in which (a) a photographic material is stored at 38° C. and 50% relative humidity for 3 days, (b) the thickness of the hydrophilic colloid layers constituting the material is measured, (c) the material is then dipped in distilled water at 21° C. for 3 minutes, and (d) the thickness of the hydrophilic colloid layers as measured after the step (c) is subtracted from the thickness as obtained in step (b).

The swelling percentage of the hydrophilic colloid layers containing at least one silver halide emulsion layer and constituting the photographic material to be processed by the method of the present invention is 250% or less, preferably from 170% to 230%.

Rapid processing performance and simplification of processing is readily attained by further reducing the swelling percentage.

On the other hand, if the swelling percentage is reduced too much, the development, fixation and rinsing rates are lowered. Therefore, reduction of the swelling percentage to the extent that the processing times are disadvantageously affected is not desired.

The hardening agent for use in the present invention includes known organic compounds such as, aldehydes; active halogen-containing compounds such as those described in U.S. Pat. No. 3,288,775; reactive ethylenic unsaturated group-having compounds such as those described in U.S. Pat. No. 3,636,718; epoxy compounds such as those described in U.S. Pat. No. 3,091,537; and halogenocarboxyaldehydes such as mucochloric acid. Of them, preferred are vinylsulfonic acid hardening agents. Also preferably used in the present invention are polymer hardening agents.

Polymer hardening agents for use in the present invention preferably are polymers having active vinyl groups and precursor groups thereof. Especially preferred are polymers having active vinyl groups or precursor groups thereof bonded to the polymer main chain via a long spacer, such as those described in JP-A 56-142524. The amount of hardening agent for addition to the photographic material of the present invention for obtaining the desired swelling percentage varies, depending upon the kind of hardening agent and the type of gelatin contained in the photographic material.

The silver halide grains for use in the present invention desirably are spectrally sensitized with sensitizing dye(s).

Useful dyes are cyanine dyes, merocyanine dyes, complex cyanine dyes, complex merocyanine dyes, holopolar cyanine dyes, hemicyanine dyes, styryl dyes and hemioxonole dyes. Especially useful dyes are cyanine dyes, merocyanine dyes and complex merocyanine dyes. The dyes may contain any basic heterocyclic nuclei which are generally found in ordinary cyanine dyes. Such nuclei include, for example, pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; nuclei condensed with alicyclic hydrocarbon ring(s); nuclei condensed with aromatic hydrocarbon ring(s), such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. The nuclei may be substituted on the carbon atom of the dyes.

Merocyanine dyes or complex merocyanine dyes for use in the present invention may have a ketomethylene structure having 5-membered or 6-membered heterocyclic nuclei, such as pyrazolin-5-one nuclei, thiohydantoin nuclei, 2-thioxazolidine-2,4-dione nuclei, thiazolidine-2,4-dione nuclei, rhodanine nuclei, thiobarbituric acid nuclei, etc.

Specific examples of spectral sensitizing dyes for use in the present invention are described, for example, *Research Disclosure*, Vol. 170, RD-17643 (December, 1978), page 23 and U.S. Pat. Nos. 4,425,425 and 4,425,426. For example, the following spectral sensitizing dyes are useful in the present invention.

5,5'-Dichloro-3,3'-diethylthiacyanine bromide
5,5'-Dichloro-3,3'-di(4-sulfobutyl)-thiacyanine sodium salt
5-Methoxy-4,5-benzo-3,3'-di(3-sulfopropyl)thiacyanine sodium salt
5,5'-Dichloro-3,3'-diethylselenocyanine iodide
5,5'-Dichloro-9-ethyl-3,3'-di(3-sulfopropyl)thiacarbocyanine pyridinium salt
Anhydro-5,5'-dichloro-9-ethyl-3-(4-sulfobutyl)-3'-ethyl hydroxide
1,1-Diethyl-2,2'-cyanine bromide
1,1-Dipentyl-2,2'-cyanine perchlorate
9-Methyl-3,3'-di(4-sulfobutyl)-thiacarbocyanine pyridinium salt
5,5'-Diphenyl-9-ethyl-3,3'-di(2-sulfoethyl)-oxacarbocyanine sodium salt
5-Chloro-5'-phenyl-9-ethyl-3-(3-sulfopropyl)-3'-(2-sulfoethyl)oxacarbocyanine sodium salt
5,5'-Dichloro-9-ethyl-3,3'-di(3-sulfopropyl)oxacarbocyanine sodium salt
5,5'-Dichloro-6,6'-dichloro-1,1'-diethyl-3,3'-di(3-sulfopropyl)imidacarbocyanine sodium salt
5,5'-Diphenyl-9-ethyl-3,3'-di(3-sulfopropyl)thiacarbocyanine sodium salt The time of adding the spectral sensitizing dye(s) to the emulsion of the present invention is generally before coating the emulsion onto a suitable support. If desired, the time of addition may also be during the chemical ripening step or during the silver halide grain forming step.

The emulsion layer(s) constituting the photographic material of the present invention may contain, a plasticizer, for example, a polymer such as a polyalkyl acrylate latex or its emulsion or a polyol such as trimethylolpropane, in order to improve pressure characteristics.

The photographic emulsion layers and other hydrophilic colloid layers constituting the photographic material for processing in accordance with the method of the present invention may contain various surfactants for the purpose of coating promotion, antistatic performance, improvement of sliding property, improvement of emulsification and dispersion, anti-blocking performance and improvement of photographic characteristics (e.g., promotion of development, elevation of contrast, sensitization).

For example, surfactants useful for these purposes include nonionic surfactants such as saponins (steroid saponins), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines or amides, silicone/polyethylene oxide adducts), glycidol derivatives (e.g., alkenylsuccinic acid polyglycerides, alkylphenol polyglycerides), fatty acid esters of polyalcohols, and alkyl esters of saccharides; anionic surfactants containing acidic group(s) of carboxyl, sulfo, phospho, sulfate and/or phosphate group (s), such as alkylcarboxylic acid salts, alkylsulfonic acid salts, alkylbenzenesulfonic acid salts, alkylnaphthalenesulfonic acid salts, alkyl sulfate esters, alkyl phosphate esters, N-acyl-N-alkyltaurines, sulfosuccinate esters, sulfoalkyl-polyoxyethylene alkylphenyl ethers, and polyoxyethylene alkyl phosphate esters; amphoteric surfactants such as amino acids, aminoalkylsulfonic acids, aminoalkylsulfate esters or phosphate esters, alkylbetaines, and aminoxides; and cationic surfactants such as alkylamine salts, aliphatic or aromatic quaternary ammonium salts, pyridinium, imidazolium and the like heterocyclic quaternary ammonium salts, and aliphatic or heterocyclic phosphonium or sulfonium salts.

The silver halide photographic material for processing in accordance with the method of the present invention has at least one silver halide emulsion layer on a support. A medical photographic material for direct X-ray exposure in accordance with the invention preferably has at least one silver halide emulsion layer on both surfaces of the support as described in JP-A 58-127921, 59-90841, 58-111934 and 61-20135.

The photographic material may additionally comprise other layers such as an interlayer, a filter layer and an anti-halation layer.

The coated silver amount in the photographic material is preferably from 0.5 g/m$^2$ to 5 g/m$^2$, more preferably from 1 g/m$^2$ to 3 g/m$^2$, per each side of the support.

The coated silver amount is preferably not more than 5 g/m$^2$ (per each side) for rapid processability of the photographic material. In order to obtain constant image density and constant contrast, the coated silver amount is desirably 0.5 g/m$^2$ or more (per each side of the support).

Gelatin is advantageously employed as a binder or protective colloid of the photographic emulsion of the present invention. If desired, other hydrophilic colloids may also be employed. For example, useful hydrophilic colloids include proteins such as gelatin derivatives, graft polymers of gelatin and other polymers, albumin, and casein; cellulose derivatives such as hydroxyethyl cellulose, carboxymethyl cellulose, and cellulose sulfate esters; saccharide derivatives such as sodium alginate, and starch derivatives; and other various synthetic hydrophilic polymer substances of homopolymers or copolymers, for example, of polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Useful gelatins include acid-processed gelatin and also a gelatin hydrolysate and an enzyme-decomposed gelatin product, in addition to a lime-processed gelatin.

Incorporation of organic substances, which dissolve out during development, into the emulsion layers and/or other hydrophilic colloid layers is preferred, particularly in X-ray photographic materials. Where the substance which dissolves out during development is gelatin, the gelatin preferably is of the type that does not react with a hardening agent (no cross linking). For example, an acetylated gelatin and a phthalated gelatin preferably having a reduced molecular weight may be used for this purpose. On the other hand, high polymer substances other than gelatin are effectively employed such as the polyacrylamides described in U.S. Pat. No. 3,271,158, as well as other hydrophilic polymers such as polyvinyl alcohol and polyvinyl pyrrolidone. Additionally, also effective are saccharides such as dextran, saccharose and pullulan. Of them, preferred are polyacrylamides and dextran; and especially preferred are polyacrylamides. The substances have a mean molecular weight of preferably 20,000 or less, more preferably 10,000 or less. The amount of substances which dissolve out from the hydrophilic layers during development is effectively from 10% to 50%, more preferably from 15% to 30%, to the total weight of the organic substances, except silver halide grains, as coated on the photographic material.

The organic substance which dissolves out during development may be incorporated into one of the emulsion layer and the surface protective layer. Where the total amount of the substance is predetermined, the substance is preferably incorporated into both the surface protective layer and the emulsion layer rather than into only the emulsion layer. More preferably, the substance is incorporated into the surface protective layer. In a multi-layered photographic material having plural emulsion layers, where the total weight of the organic substance (which dissolved out during development) to be incorporated is predetermined, a larger amount of the substance is in the emulsion layer(s) nearer or nearest to the surface protective layer.

Antistatic agents preferably incorporated into the photographic material of the present invention include, for example, fluorine-containing surfactants or polymers such as those described in JP-A 62-109044 and 62-215272; nonionic surfactants such as those described in JP-A 60-76742, 60-80846, 60-80848, 60-80839, 60-76741, 58-62-172343, 62-173459 and 62-215272; and nonionic, anionic, cationic or amphoteric conductive polymers or latexes such as those described in JP-A 57-204540 and 62-215272. Inorganic antistatic agents of conductive tin oxide and zinc oxide and also their complex metal oxides as doped with antimony or the like are also preferably employed as described in JP-A-57-118242.

As the antistatic agent, especially preferred are fluorine-containing surfactants.

The photographic material of the present invention may contain a matting agent of fine grains of an organic compound such as a homopolymer of polymethyl methacrylate or a copolymer of methyl methacrylate and methacrylic acid, and starch, or an inorganic compound such as silica, titanium dioxide, strontium sulfate, or barium sulfate. The grain size of the matting agent grains may be from 1.0 to 10 $\mu$m, especially preferably from 2 to 5 $\mu$m.

The photographic emulsion layers and other layers of the silver halide photographic material of the present invention may be colored with dyes for absorbing light falling within a particular wavelength range i.e., for anti-halation or anti-irradiation, or the photographic material may have a filter layer in order to control introduction of the spectral composition of light into the photographic emulsion layers. A duplicate-coated film such as a direct X-ray film for medical use may have a crossover-cutting layer below the emulsion layers. Useful dyes include, for example, oxonole dyes having a pyrazolone nucleus or barbituric acid nucleus, and also azo dyes, azomethine dyes, anthraquinone dyes, arylidene dyes, styryl dyes, triarylmethane dyes, merocyanine dyes and cyanine dyes.

In employing these dyes, it is effective to mordant an anionic dye in a particular layer of the photographic material with a cationic site-containing polymer. The dye for use in this case is preferably one which may be irreversibly decolored during the process of development, fixation and rinsing steps. The layer in which a dye is to be mordanted with a cationic site-containing polymer may be either a surface protective layer or an additional layer formed on the surface of the support opposite the emulsion layer-coated surface. The dye-containing layer is preferably between the emulsion layer and the support. In particular, for the purpose of crossover-cutting in an X-ray duplicate-coated film for medical use, the dye is most preferably mordanted in the subbing layer.

A preferred coating aid for the subbing layer is a polyethylene oxide nonionic surfactant for use in combination with the cationic site-containing polymer.

The cationic site-providing polymer, preferably is an anion-converting polymer.

Various known quaternary ammonium salt (or phosphonium salt) polymers may be used as the anion-converting polymer. Quaternary ammonium (or phosphonium salt) polymers are well known as mordant polymers or antistatic polymers, for example, as described in the following publications.

Useful polymers include the aqueous polymer latex dispersions described in JP-A 59-166940, U.S. Pat. No. 3,958,995, JP-A 55-142339, 54-126027, 54-155835, 53-30328 and 54-92274; polyvinyl pyridinium salts as described in U.S. Pat. Nos. 2,548,564, 3,148,061 and 3,756,814; water-soluble quaternary ammonium salt polymers described in U.S. Pat. No. 3,709,690; and water-insoluble ammonium salt polymers described in U.S. Pat. No. 3,898,088.

Especially preferably, the polymer is further copolymerized with monomer(s) having 2 or more, preferably from 2 to 4 ethylenic unsaturated groups to form a crosslinked aqueous polymer latex prior to addition to a predetermined layer of the photographic material, In that case, the polymer does not diffuse from the intended layer to other layers or to the processing solution, to thereby avoid any photographically unfavorable effects on the photographic material being processed.

For fixation of the dye, the solid dispersion method as described, for example, in JP-A 55-155350 and WO88/04794 is also effective.

The photographic material for processing in accordance with the method of the present invention may be composed to have an ultra-hard photographic characteristic (i.e., high contrast) by using a hydrazine nucleating agent. Useful high contrast systems (especially for graphic arts) and hydrazine nucleating agents are described, for example, in *Research Disclosure*, Item 23516 (November, 1983, p. 346) and publications as referred to therein; U.S. Pat. Nos. 4,080,207, 4,269,929, 4,276,364, 4,278,748, 4,385,108, 4,459,347, 4,560,638, 4,478,928; British Pat. 2,011,391B; JP-A-60-179734, 62-270,948, 63-29751, 61-170733, 61-270744, 62-948; EP 217,310; JP-A 63-32538, 63-104047, 63-121838, 63-129337, 63-234245, 63-234246, 63-223744, 63-294552, 63-306438, 64-10233; U.S. Pat. No. 4,686,167; JP-A-62-178246, 63-234244, 64-90439, 1-276128, 1-283548, 1-280747, 1-283549, 1-285940, 2-2541, 2-139538, 2-177057, 2-198440, 2-198441, 2-198442, 2-196234, 2-196235, 2-220042, 2-221953, 2-221954.

Where a hydrazine nucleating agent is incorporated into the photographic material, it is preferably added to the silver halide emulsion layer. The hydrazine nucleating agent may also be added to a non-light-sensitive hydrophilic colloid layer (e.g., protective layer, interlayer, filter layer, anti-halation layer). The addition amount of the hydrazine nucleating agent is preferably from $1\times10^{-6}$ to $5\times10^{-2}$ mol, especially preferably from $1\times10^{-5}$ to $2\times10^{-2}$ mol, per mol of silver halide in the emulsion layer (when the agent is added into a light-sensitive silver halide emulsion layer, it is calculated based on the amount of silver halide in the same layer, when the agent is added into a light-insensitive silver halide emulsion layer provided between two light-sensitive silver halide emulsion layers, it is calculated based on the amount of silver halide in light-sensitive silver halide emulsion layer containing larger amount of silver halide, and when the photographic material has only one light-sensitive silver halide emulsion layer it is calculated based on the silver halide in the silver halide emulsion layer).

Effective development accelerator or nucleating infectious development accelerator suitably employed in the ultra-hard photographic system are the compounds described in JP-A-53-77616, 54-37732, 53-137133, 60-140340 and 60-14959, and also other various nitrogen or sulfur atom-containing compounds.

The optimum addition amount thereof varies depending on the kind of compound selected, and is generally in the range of from $1.0\times10^{-3}$ to 0.5 g/m$^2$, more preferably from $5.0\times10^{-3}$ to 0.1 g/m$^2$.

The ultra-hard photographic system may further employ a redox compound which releases a development inhibitor. Useful redox compounds, for example, are described in JP-A-2-293736, 2-308239, 1-154060 and 1-205885. The addition amount of the redox compound to the system is generally from $1\times10^{-6}$ to $5\times10^{-2}$ mol, especially preferably from $1\times10^{-5}$ to $1\times10^{-2}$ mol, per mol of silver halide (the basis of calculation of the amount is the same as disclosed hereinabove for a hydrazine nucleating compound).

The photographic material for processing in accordance with the method of the present invention may contain various compounds for preventing the material from fogging and for stabilizing the photographic properties of the material during the manufacture, storage and processing thereof. More particularly, the photographic material may contain various compounds known as antifoggant or stabilizers, for example, azoles such as benzothiazolium salts, nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazolinethiones; azaindenes such as triazaindenes, tetrazaindenes (especially, 4-hydroxy-substituted (1,3,3a,7)tetrazaindenes), pentazaindenes; and also benzenethiosulfonic acids, benzenesulfinic acids and benzenesulfonic acid amides. Of these, especially preferred are benzotriazoles (for example, 5methyl-benzotriazole) and nitroindazoles (for example, 5-nitroindazole). The compounds may be incorporated into the processing solutions, if desired, for use in the method of the present invention. In addition, a compound which releases a development inhibitor during development, such as those described in JP-A-62-30243, may be added to the photographic material as a stabilizer or a black pepper inhibitor.

The photographic material for processing in accordance with the method of the present invention may contain a developing agent such as hydroquinone derivative or a phenidone derivative as a stabilizer or accelerator, or for other various purposes.

The photographic material for processing in accordance with the method of the present invention may contain an inorganic or organic hardening agent in the photographic emulsion layer or in any other hydrophilic colloid layer. For example, the photographic material may contain chromium salts (e.g., chromium alum, chromium acetate), aldehydes (e.g., formaldehyde, glutaraldehyde), N-methylol compounds (e.g., dimethylolurea), dioxane derivatives, active vinyl compounds (e.g., 1,3,5-triacryloyl-hexahydro-s-triazine, 1,3-vinylsulfonyl-2propanol), active halogen compounds (e.g., 2,4-dichloro-6-hydroxy-s-triazine) and mucohalogenic acids (mucochloric acid), used singly or in combination thereof.

The photographic material for processing in accordance with the method of the present invention may contain a hydroquinone derivative (namely, a DIR-hydroquinone) which releases a development inhibitor in accordance with the image density during development, in the photographic emulsion layer or in any other hydrophilic colloid layer.

Specific examples of the hydroquinone derivative include the compounds described in U.S. Pat. No. 3,379,529, 3,620,746, 4,377,634, 4,332,878, JP-A-49-t29536, 54-67419, 56-153336, 56-153342, 59-278853, 59-90435, 59-90436 and 59-138808.

The photographic material for processing in accordance with the method of the present invention may contain a dispersion of a water-insoluble or scarcely water-soluble synthetic polymer for dimension stabilization. Useful polymers include, for example, homopolymers or copolymers composed of alkyl (meth)acrylates, alkoxyalkyl (meth)acrylates and glycidyl (meth)acrylates singly or in combination, optionally along with other comonomers, for example, of acrylic acid and methacrylic acid.

The photographic material for processing in accordance with the method of the present invention preferably contains an acid group-containing compound in the silver halide emulsion layer and optionally in other layers. Examples of the acid group-containing compound are organic acids such as salicylic acid, acetic acid and ascorbic acid, and also polymers and copolymers having, as repeating units, acid monomer(s) such as acrylic acid, maleic acid and phthalic acid. Regarding these compounds, the descriptions of JP-A 61-223834 (U.S. Pat. No. 4,824,774), 61-228437 (U.S. Pat. No. 4,849,319), 62-25745 and 62-55642 (U.S. Pat. No. 4,755,448) are referred to. Of these compounds, especially preferred are ascorbic acid as a low molecular compound, and a water-dispersing latex of a copolymer composed of an acid monomer such as acrylic acid and a crosslinking monomer having two or more unsaturated groups such as divinylbenzene as a high molecular weight compound.

In forming the photographic material for processing in accordance with the method of the present invention, the silver halide emulsion prepared as described above is coated and dried on a support such as a cellulose acetate film or polyethylene terephthalate film by dip-coating, air knife-coating, bead-coating, extrusion doctor-coating or duplicate-coating.

The method of the present invention may also be applied to color photographic materials. In this case, various color couplers may be employed. Color couplers as referred to herein are compounds which form a dye by coupling reaction with an oxidation product of an aromatic primary amine developing agent. Preferred examples of useful color couplers are naphthol or phenol compounds, pyrazolone or pyrazoloazole compounds and non-cyclic or heterocyclic ketomethylene compounds. Specific examples of such cyan, magenta and yellow couplers for use in the present invention are described, for example, in the patent publications referred to in *Research Disclosure* (RD) 17643 (December, 1978), VII-D; and ibid., 18717 (November, 1979).

Other various photographic additives for use in the present invention are described, for example, in the above-mentioned *Research Disclosure* No. 17643, pp. 23–28, and ibid., No. 18716, pp. 648–651. A list of photographic additives which may be used in the present invention is given below.

| | Kinds of Additive | RD 17643 | RD 18716 |
|---|---|---|---|
| 1 | Chemical Sensitizer | page 23 | page 648, right column |
| 2 | Sensitivity Enhancer | | page 648, right column |
| 3 | Spectral Sensitizing Agent | pages 23 to 24 | page 648, right column, to page 649, right column |
| | Super Spectral Sensitizing Agent | pages 23 to 24 | page 648, right column, to page 649, right column |
| 4 | Brightening Agent | page 24 | |
| 5 | Anti-foggant | pages 24 to 25 | page 649, right column |
| | Stabilizer | pages 24 to 25 | page 649, right column |
| 6. | Light Absorbent | pages 25 to 26 | page 649, right column to page 650, left column |
| | Filter Dye | pages 25 to 26 | page 649, right column to page 650, left column |
| | Ultraviolet Absorbent | pages 25 to 26 | page 649, right column to page 650, left column |
| 7 | Stain Inhibitor | page 25, right column | page 650, left column to right column |
| 8 | Color Image Stabilizer | page 25 | |
| 9 | Hardening Agent | page 26 | page 651, left column |
| 10 | Binder | page 26 | page 651, left column |

The present invention will be explained in more detail by way of the following Examples, which, however, are not intended to restrict the scope of the present invention.

EXAMPLE 1

Preparation of Emulsion A

| | |
|---|---|
| Liquid Composition 1: | |
| Water | 1.0 liter |
| Gelatin | 20 g |
| Sodium Chloride | 20 g |
| 1,3-Dimethylimidazolidine-2-thione | 20 mg |
| Sodium Benzenesulfonate | 8 mg |
| Liquid Composition 2: | |
| Water | 400 ml |
| Silver Nitrate | 100 g |
| Liquid Composition 3: | |
| Water | 400 ml |
| Sodium Chloride | 27.1 g |
| Potassium Bromide | 21 g |
| Potassium Hexachloroiridate (III) (0.001 wt % aqueous solution) | 15 ml |
| Ammonium Hexabromorhodate (III) (0.001 wt % aqueous solution) | 1.5 ml |

Liquid composition 2 and liquid composition 3 were simultaneously added to liquid composition 1 at 38° C. and pH 4.5, over a period of 10 minutes to form nuclear grains of 0.16 μm. Subsequently, the following liquid composition 4 and liquid composition 5 were added thereto over a period of 10 minutes. In addition, 0.15 g of potassium iodide was added thereto to complete formation of the grains.

| | |
|---|---|
| Liquid Composition 4: | |
| Water | 400 ml |
| Silver Nitrate | 100 g |
| Liquid Composition 5: | |
| Water | 400 ml |
| Sodium Chloride | 27.1 g |
| Potassium Bromide | 21 g |
| Potassium Hexacyanoferrate (III) (0.1 wt % aqueous solution) | 5 ml |

Next, the grains thus formed were washed by conventional flocculation, and 30 g of gelatin was added thereto.

The emulsion thus prepared was adjusted to have a pH of 5.3 and a pAg of 7.5; and 2.6 mg of sodium thiosulfate, 1.0 mg of triphenylphosphine selenide and 6.2 mg of chloroauric acid were added thereto, and 4 mg of sodium benzenethiosulfonate and 1 mg of sodium benzenesulfinate were added thereto, to chemically sensitize the emulsion to optimum sensitivity.

200 mg of the stabilizer 4-hydroxy-6-methyl-1,3,3a,7-tetrazaindene was added to the emulsion along with the antiseptic phenoxyethanol. Finally, an emulsion of cubic silver iodochlorobromide grains having a silver chloride content of 70 mol % and having a mean grain size of 0.2 μm was obtained. The grain size fluctuation coefficient was 9%.

Formation of Coated Sample:

The emulsion prepared above was ortho-sensitized by adding an ortho-sensitizing dye (described below) in an amount of $5\times10^{-4}$ mol/mol of Ag. As antifoggants, hydroquinone and 1-phenyl-5-mercaptotetrazole were added thereto in amounts of 2.5 g and 50 mg, respectively, per mol of silver; as a plasticizer, polyethyl acrylate latex was added in an amount of 25 wt % to gelatin binder; as a hardening agent, 2-bis(vinylsulfonylacetamido)ethane was added; and colloidal silica was added in an amount of 40 wt % to gelatin binder. The resulting emulsion was then coated onto a polyester support so that the coated silver amount was 3.0 g/m$^2$, and the coated gelatin amount 1.0 g/m$^2$. Over the emulsion layer thus coated, the following lower protective layer and upper protective layer were superposed by simultaneous coating.

Ortho-sensitizing Dye:

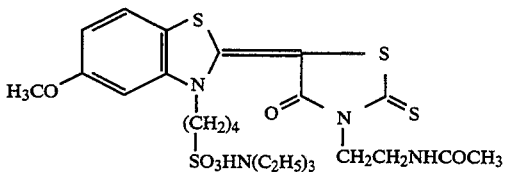

-continued

| Lower Protective Layer: | |
|---|---|
| Gelatin | 0.25 g/m$^2$ |
| Sodium Benzenethiosulfonate | 4 mg/m$^2$ |
| 1,5-Dihydroxy-2-benzaldoxime | 25 mg/m$^2$ |
| Polyethyl Acrylate Latex | 125 mg/m$^2$ |
| Upper Protective Layer: | |
| Gelatin | 0.25 g/m$^2$ |
| Silica Matting Agent having a mean grain size of 2.5 μm | 50 mg/m$^2$ |
| Compound 1 (in gelatin dispersion) | 30 mg/m$^2$ |
| Colloidal Silica of grain size of 10 to 20 mμ | 30 mg/m$^2$ |
| Compound 2 | 5 mg/m$^2$ |
| Sodium Dodecylbenzenesulfonate | 22 mg/m$^2$ |

Compound 1:

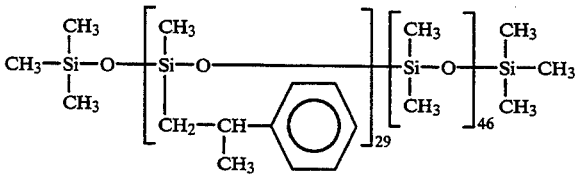

(29:46: mean polymerization degree)

Compound 2:

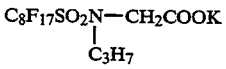

The support base (polyethylenetelephthalate) had the following backing layer and backing layer-protective layer.

| Backing Layer: | |
|---|---|
| Sodium Dodecylbenzenesulfonate | 80 mg/m$^2$ |
| Compound 3 | 70 mg/m$^2$ |
| Compound 4 | 85 mg/m$^2$ |
| Compound 5 | 90 mg/m$^2$ |
| 1,3-Divinylsulfone-2-propanol | 60 mg/m$^2$ |

Compound 3:

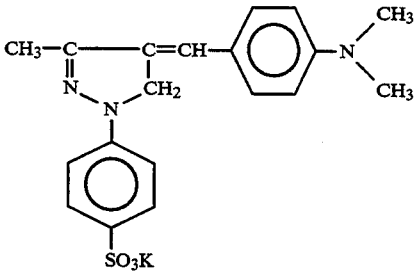

Compound 4:

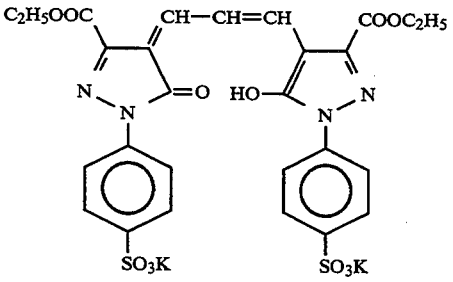

Compound 5:

-continued

Backing Layer:

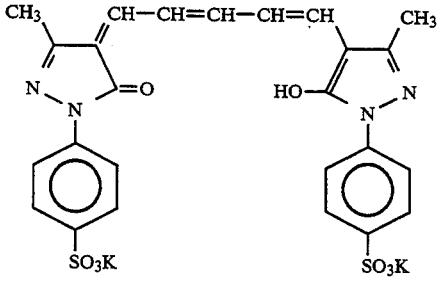

| Backing Layer-protective Layer: | |
|---|---|
| Gelatin | 0.5 g/m$^2$ |
| Polymethyl Methacrylate (grain size 4.7 μm) | 30 mg/m$^2$ |
| Sodium Dodecylbenzenesulfonate | 20 mg/m$^2$ |
| Compound 2 | 2 mg/m$^2$ |
| Compound 1 (in gelatin dispersion) | 100 mg/m$^2$ |

A coated sample was prepared as described above.

Compositions of Processing Solutions

| Developer: | |
|---|---|
| Diethylenetriamine-pentaacetic Acid | 2.0 g |
| Sodium Carbonate | 5.0 g |
| Boric Acid | 10.0 g |
| Potassium Sulfite | 85.0 g |
| Sodium Bromide | 6.0 g |
| Diethylene Glycol | 40.0 g |
| 5-Methylbenzotriazole | 0.2 g |
| Sodium 2-Mercaptobenzimidazole-5-sulfonate | 0.3 g |
| Hydroquinone | 30.0 g |
| 4-Hydroxymethyl-4-methyl-1-phenyl-3-pyrazolidone | 1.6 g |
| Compound shown in Table 1 | 0.1 mol/liter |
| Potassium Hydroxide and Water to make | 1 liter |
| | pH 10.7 |

500 ml of the developer was placed in a 1000 ml beaker and covered with a Saran film. The covering film was punched to make a hole having a diameter of 2 mm, and the developer was stored as such for 10 days at room temperature. After storage under these conditions, the amount of remaining hydroquinone in the stored developer and the pH value of the stored developer were measured. The results obtained are shown in Table 1 below.

TABLE 1 pH and Remained Hydroquinone Amount in Developer Stored for 10 Days

| No. | Compound Added to Developer | pH | Amount of Remained Hydroquinone (%) | |
|---|---|---|---|---|
| 1 | Control (None added) | 11.62 | 10% | comparative example |
| 2 | Ascorbic Acid | 10.02 | 55% | comparative example |
| 3 | Compound A-5 | 10.89 | 65% | example of the invention |
| 4 | Compound A-23 | 10.73 | 70% | example of the invention |
| 5 | Compound A-41 | 10.95 | 58% | example of the invention |
| 6 | Compound A-53 | 10.55 | 67% | example of the invention |
| 7 | Compound | 10.85 | 77% | example of the |

TABLE 1-continued pH and Remained Hydroquinone Amount in Developer Stored for 10 Days

| No. | Developer | pH | Hydroquinone (%) | |
|---|---|---|---|---|
| | A-65 | | | invention |
| 8 | Compound A-68 | 11.05 | 72% | example of the invention |
| 9 | Compound B-10 | 11.02 | 63% | example of the invention |

| Fixer: | |
|---|---|
| Disodium Ethylenediaminetetraacetate | 0.025 g |
| Sodium Sulfite | 7.0 g |
| Sodium Metabisulfite | 20.0 g |
| Sodium Thiosulfate 5-Hydrate | 300.0 g |
| Water to make | 1 liter |
| | pH 5.7 |

Evaluation of Photographic Properties

Film samples prepared as described above were exposed to a xenon flash ray for $10^{-6}$ second via an interference filter having a peak of 488 nm and a continuous wedge. The exposed samples were developed either with the above-described fresh developer or the 10 day-aged developer, using an automatic developing machine FG-710NH (manufactured by Fuji Photo Film Co.). The conditions of the development process are given below.

| | | |
|---|---|---|
| Development | 38° C. | 12.3 sec |
| Fixation | 37° C. | 12.2 sec |
| Rinsing | 26° C. | 6.6 sec |
| Drying | 55° C. | 13.3 sec |

The photographic properties of the processed sample were evaluated as described below. The gradation is represented as a value obtained by dividing the difference between the density 3.0 and the density 0.1 by the difference between the logarithmic exposure amount providing a density of 3.0 and the logarithmic exposure amount providing a density of 0.1. The sensitivity is represented relative to the sensitivity (100) of the film sample processed with fresh developer (control: to which no additive was added), which is the reciprocal of the exposure amount needed to obtain a density of 1.5.

Table 2 below shows the results of the photographic properties of the samples as processed with the fresh developer and the 10 day-aged developer.

TABLE 2

| No. | Compound Added to Developer | Developer | Photographic Properties Sensitivity | Gradation | |
|---|---|---|---|---|---|
| 1 | Control (none added) | fresh developer | 100 | 6.1 | comparative |
| | | aged developer | 65 | 3.8 | example |
| 2 | Ascorbic Acid | fresh developer | 100 | 5.9 | comparative |
| | | aged developer | 75 | 4.8 | example |
| 3 | Compound A-5 | fresh developer | 100 | 6.0 | example of |
| | | aged developer | 90 | 5.4 | the invention |
| 4 | Compound A-23 | fresh developer | 101 | 6.0 | example of |
| | | aged developer | 88 | 5.0 | the invention |
| 5 | Compound A-41 | fresh developer | 100 | 6.1 | example of |
| | | aged developer | 92 | 5.5 | the invention |
| 6 | Compound A-53 | fresh developer | 99 | 5.9 | example of |
| | | aged developer | 84 | 5.1 | the invention |
| 7 | Compound A-65 | fresh developer | 100 | 6.0 | example of |
| | | aged developer | 88 | 5.0 | the invention |
| 8 | Compound A-68 | fresh developer | 100 | 6.0 | example of |
| | | aged developer | 91 | 5.5 | the invention |
| 9 | Compound B-10 | fresh developer | 100 | 6.0 | example of |
| | | aged developer | 85 | 5.1 | the invention |

As shown by Tables 1 and 2 above, addition of the compound of the present invention protected the developer from becoming aged and fatigued by aerial oxidation, so that little hydroquinone was decomposed and fluctuation of the pH value was small. In addition, variation in photographic properties (sensitivity, gradation) of the film samples as processed with the fresh developer and the aged and fatigued developer both containing the compound of the present invention was small, to thereby provide for stable development processing.

EXAMPLE 2

First Light-sensitive Emulsion Layer

Preparation of Light-sensitive Emulsion A

An aqueous 0.37 M silver nitrate solution and an aqueous halide solution containing $1\times10^{-7}$ mol, per mol of silver, of $(NH_4)_3RhCl_6$ and $5\times10^{-7}$ mol, per mol of silver, of $K_3IrCl_6$ and containing 0.11M potassium bromide and 0.27M sodium chloride were added to an aqueous gelatin solution containing sodium chloride and 1,3-dimethyl-2-imidazolidinethione, by a double jet method at 45° C. over a period of 12 minutes to form (by nucleation) silver chlorobromide grains having a mean grain size of 0.20 μm and a silver chloride content of 70 mol %. Subsequently, an aqueous 0.63M silver nitrate solution and an aqueous halide solution containing 0.19M potassium bromide and 0.47M sodium chloride were added thereto also by a double jet method over a period of 20 minutes. Afterwards, a solution containing $1\times10^{-3}$ mol KI was added to the emulsion for halogen conversion, and the emulsion was then washed by ordinary flocculation. 40 g of gelatin was added thereto, and the emulsion was adjusted to a pH of 6.5 and a pAg of 7.5. 5 mg, per mol of silver, of sodium thiosulfate, 8 mg, per mol of silver, of chloroauric acid and 7 mg, per mol of silver, of sodium benzenethiosulfonate were added to the emulsion which was then heated at 60° C. for 45 minutes for chemical sensitization of the emulsion. Then, 150 mg of stabilizer 4-hydroxy-6-methyl-1,3,3a,7-tetrazaindene was added thereto along with Proxel (trade name; manufactured by ICI Co.; 1,2-benzisothiazoline-3-one) and phenoxyethanol. The grains thus formed were cubic silver chlorobromide grains having a mean grain size of 0.28 μm and a silver chloride content of 70 mol %. The grain size fluctuation coefficient was 9%.

Coating of First Light-sensitive Emulsion Layer

The emulsion prepared as described above was divided into plural parts, and $1\times10^{-3}$ mol, per mol of silver, of the sensitizing dye 5-[3-(4-sulfobutyl)-5-chloro-2-benzoxazolidylidene]-1-hydroxyethoxyethyl-3-(2-pyridyl)-2-thiohydantoin potassium salt and also $2\times10^{-4}$ mol, per mol of silver, of 1-phenyl-5-mercaptotetrazole and $5\times10^{-4}$ mol, per mol of silver, of a cyanine dye of the following compound (a) were added thereto along with a polymer of the following compound (b) (200 mg/m$^2$), hydroquinone (50 mg/m$^2$), a dispersion of polyethyl acrylate (solid content: 200 mg/m$^2$), the hardening agent 1,3-bisvinylsulfonyl-2-propanol (200 mg/m$^2$) and the following hydrazine compound (c) ($2.8\times10^{-5}$ mol/m$^2$). The resulting composition was coated on a support to provide a coated silver amount of 3.6 g/m$^2$ and a coated gelatin amount of 2.0 g/m$^2$.

Compound (a):

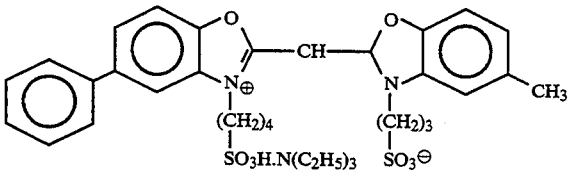

Compound (b):

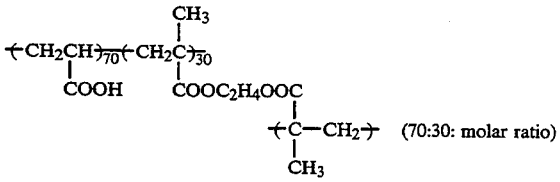

Hydrazine Compound (c):

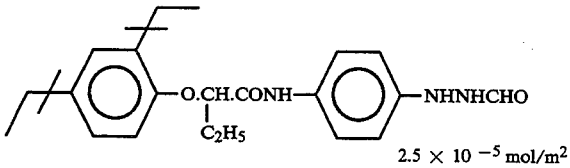

$2.5\times10^{-5}$ mol/m$^2$

Coating of Interlayer:

| | |
|---|---|
| Gelatin | 1.0 g/m2 |
| 1,3-Bisvinylsulfonyl-2-propanol | 4.0 wt. % to gelatin |

Second Light-sensitive Emulsion Layer

Preparation of Light-sensitive Emulsion B

An aqueous 1.0M silver nitrate solution and an aqueous halide solution containing $3\times10^{-7}$ mol, per mol of silver, of $(NH_4)_3RhCl_6$ and containing 0.3M potassium bromide and 0.74M sodium chloride were added to an aqueous gelatin solution containing sodium chloride and 1,3-dimethyl-2-imidazolidinethione, by a double jet method at 45° C. over a period of 30 minutes to form silver chlorobromide grains having a mean grain size of 0.28 μm and a silver chloride content of 70 mol %. Subsequently, the emulsion was washed by ordinary flocculation. 40 g of gelatin was added thereto, and the emulsion was adjusted to a pH of 6.5 and a pAg of 7.5. 5 mg, per mol of silver, of sodium thiosulfate and 8 mg, per mol of silver, of chloroauric acid were added to the emulsion which was then heated at 60° C. for 60 minutes for chemical sensitization of the emulsion. Then, 150 mg of the stabilizer 4-hydroxy-6-methyl-1,3,3a,7-tetrazaindene was added thereto. The grains thus formed were cubic silver chlorobromide grains having a mean grain size of 0.28 μm and a silver chloride content of 70 mol %. The grain size fluctuation coefficient was 10%.

Coating of First Light-sensitive Emulsion Layer

The emulsion B prepared above was again dissolved, and $1.0\times10^{-3}$ mol, per mol of silver, of the sensitizing dye 5-[3-(4-sulfobutyl)-5-chloro-2-benzoxazolidylidene]-1-hydroxyethoxyethyl-3-(2-pyridyl)-2-thiohydantoin potassium salt and $1.0\times10^{-3}$ mol, per mol of silver, of a KI solution were added thereto. Then, $2\times10^{-4}$ mol, per mol of silver, of 1-phenyl-5-mercaptotetrazole was added thereto along with a dispersion of polyethyl acrylate (50 mg/m$^2$), the hardening agent 1,3-bisvinylsulfonyl-2-propanol (4.0 wt. % to gelatin) and the following redox compound ($1.0\times10^{-4}$ mol/m$^2$). The resulting composition was coated on a support to provide a coated silver amount of 0.2 g/m$^2$ and a coated gelatin amount of 0.3 g/m$^2$.

Redox Compound:

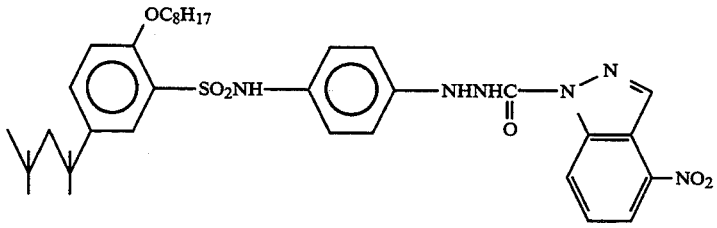

Coating of Protective Layer

A protective layer was coated over the second light-sensitive emulsion layer which comprised gelatin in an amount of 1.0 g/m$^2$ and polymethyl methacrylate grains (mean grain size 2.5 μm) in an amount of 0.3 g/m$^2$ along with the following surfactant composition.

| | |
|---|---|
| 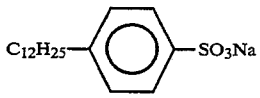 | 37 mg/m$^2$ |
| $CH_2COOC_6H_{13}$<br>\|<br>$CHCOOC_6H_{13}$<br>\|<br>$SO_3Na$ | 37 mg/m$^2$ |
| $C_8F_{17}SO_2NCH_2COOK$<br>\|<br>$C_3H_7$ | 2.5 mg/m$^2$ |

The support was coated with the following backing layer and back protective layer.

| Backing Layer: | |
|---|---|
| Gelatin | 3 g/m$^2$ |
| Polyethyl Acrylate Latex | 2 g/m$^2$ (solid content) |
| Surfactant Sodium P-dodceylbenzenesulfonate | 40 mg/m$^2$ |
| Gelatin Hardening Agent | 110 mg/m$^2$ |
| $CH_2{=}CHSO_2CH_2CONH$<br>$(CH_2)_2$<br>$CH_2{=}CHSO_2CH_2CONH$ | |
| Mixture of Dyes (a), (b) and (c): | |
| Dye (a) | 50 mg/m$^2$ |
| 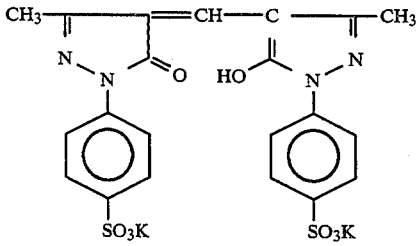 | |
| Dye (b) | 100 mg/m$^2$ |
| 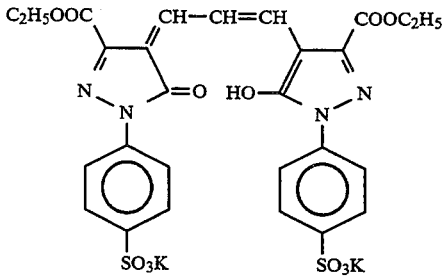 | |
| Dye (c) | 50 mg/m$^2$ |
| 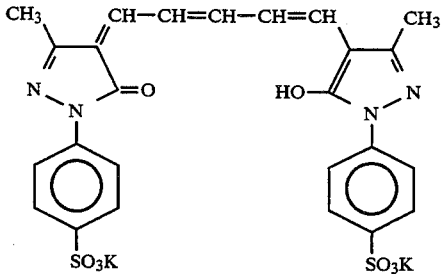 | |

| Back protective Layer: | |
|---|---|
| Gelatin | 0.8 g/m$^2$ |
| Fine Polymethyl Methacrylate Grains (mean grain size 4.5 μm) | 30 mg/m$^2$ |
| Sodium Dihexyl-α-sulfosuccinate | 15 mg/m$^2$ |
| Sodium Dodecylbenzenesulfonate | 15 mg/m$^2$ |
| Sodium Acetate | 40 mg/m$^2$ |
| Fluorine-containing Surfactant | 5 mg/m$^2$ |
| $C_8F_{17}SO_2N{-}CH_2COOK$<br>\|<br>$C_3H_7$ | |

On a polyester film support (100 μm) were coated the first light-sensitive emulsion layer as the lowermost layer, the redox compound-containing second light-sensitive emulsion layer via the interlayer, and the protective layer in this order by simultaneous coating. Thus, coated sample C was prepared.

Compositions of Processing Solutions

| Developer: | |
|---|---|
| Hydroquinone | 50.0 g |
| N-methyl-p-aminophenol | 0.3 g |
| Sodium Hydroxide | 18.0 g |
| 5-Sulfosalicylic Acid | 30.0 g |
| Boric Acid | 25.0 g |
| Potassium Sulfite | 124.0 g |
| Disodium Ethylenediaminetetraacetate | 1.0 g |
| Potassium Bromide | 10.0 g |
| 5-Mehtylbenzotriazole | 0.4 g |
| Sodium 3-(5-Mercaptotetrazole) benzenesulfonate | 0.2 g |
| N-n-butyldiethanolamine | 15.0 g |
| Sodium Toluenesulfonate | 8.0 g |
| Sodium 2-Mercaptobenzimidazole-5-sulfonate | 0.3 g |
| Compound shown in Table 3 | 0.1 mol/liter |
| Water and Potassium Hydroxide to make | 1 liter |
| | (pH of 11.6) |

500 ml of the developer were placed in a 1000 ml-beaker and covered with a film of Saran film. The covering film was punched to make a hole having a diameter of 2 mm, and the developer was stored as such for 5 days at room temperature.

Evaluation of Photographic Properties

The coated film samples C prepared as described above were exposed to 3200° K. tungsten light through a sensitometric optical wedge. The exposed samples were developed either with the above-described fresh developer or 5 day-aged developer, using the same automatic developing machine as used in Example 1, at 34° C. for 30 seconds. The fixer used to process these samples was GR-F1 (produced by Fuji Photo Film Co.). The photographic properties of the sample evaluated as in Example 1 above and processed with either the fresh developer or the aged developer are shown in Table 3 below.

TABLE 3

| No. | Compound Added to Developer | Developer | Photographic Properties Sensitivity | Gradation | |
|---|---|---|---|---|---|
| 1 | Control (none added) | fresh developer | 100 | 14.1 | comparative |
| | | aged developer | 80 | 9.2 | example |
| 2 | Compound A-3 | fresh developer | 100 | 14.0 | example of |
| | | aged developer | 93 | 13.3 | the invention |
| 3 | Compound A-40 | fresh developer | 100 | 14.2 | example of |
| | | aged developer | 95 | 13.4 | the invention |
| 4 | Compound A-69 | fresh developer | 101 | 14.0 | example of |
| | | aged developer | 92 | 13.0 | the invention |
| 5 | Compound B-11 | fresh developer | 100 | 14.1 | example of |
| | | aged developer | 95 | 12.9 | the invention |

As shown in Table 3 above, the developer containing the compound of the present invention maintained sufficient photographic properties of high sensitivity and high contrast even after storage for 5 days. Namely, aerial oxidation of the developer to fatigue and ageing was retarded by the compound of the invention added thereto, to thereby achieve the objects of the present invention.

EXAMPLE 3

Preparation of Tabular Pure Silver Bromide Grains:

6 g of potassium bromide and 7 g of gelatin were added to one liter of water in a container at 55° C. 37 ml of an aqueous silver nitrate solution (containing 4.00 g of silver nitrate) and 38 ml of an aqueous solution containing 5.7 g of potassium bromide were added to the container with stirring, by a double jet method over a period of 37 seconds. Next, 18.6 g of gelatin was added thereto. After the temperature of the reaction system was elevated to 70° C., 89 ml of an aqueous silver nitrate solution (containing 9.8 g of silver nitrate) was added thereto over a period of 22 minutes. 7 ml of an aqueous 25 wt % ammonia solution was added thereto, and the emulsion was physically ripened at the temperature (70° C.) for 10 minutes, and 6.5 ml of 100% acetic acid solution was added thereto. Subsequently, an aqueous solution containing 153.0 g of silver nitrate and an aqueous potassium bromide solution were added thereto by a controlled double jet method at pAg of 8.5 over a period of 35 minutes. The emulsion was adjusted to a pAg of 2.8 with an aqueous silver nitrate solution, and 15 ml of 2N potassium thiocyanate solution was added thereto. The emulsion was thus subjected to physical ripening at the temperature (70° C.) for 5 minutes, and then the temperature was lowered to 35° C. Thus, monodispersed tabular grains having a mean projected area diameter of 1.11 μm, a mean thickness of 0.164 μm and a diameter fluctuation coefficient of 18.0% were obtained.

Soluble salts were removed from the emulsion by flocculation. The emulsion was again heated up to 40° C., and 30 g of gelatin, 2.35 g of phenoxyethanol and 0.8 g of the viscosity-increasing agent sodium polystyrenesulfonate were added thereto. Then, the emulsion was adjusted to a pH of 5.90 and a pAg of 8.25 with sodium hydroxide solution and silver nitrate solution.

Preparation and Chemical Ripening of Emulsion:

The grains prepared above were subjected to chemical ripening at 56° C. with stirring. Particularly, 0.043 mg of thiourea dioxide was first added to the grains, which were then left standing for 20 minutes for reduction sensitization. Next, 0.15 mol %, to the total silver weight, of fine silver iodide grains having a diameter of 0.07 μm were added to the emulsion, and then 20 mg of 4-hydroxy-6-methyl-1,3,31,7-tetrazaindene, 400 mg of the following sensitizing dye I and 4.2 mg of the following sensitizing dye II were added thereto. Furthermore, 0.83 mg of calcium chloride (in the form of an aqueous solution) was added thereto. Subsequently, 1.3 mg of sodium thiosulfate, 3.4 mg of the following selenium compound I, 2.6 mg of chloroauric acid and 90 mg of potassium thiocyanate were added thereto. After 40 minutes, the reaction system was cooled to 35° C. to provide an emulsion having a total silver iodide content of 0.15 mol %.

Sensitizing Dye I:

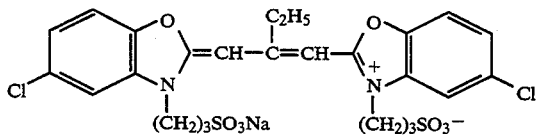

Sensitizing Dye II:

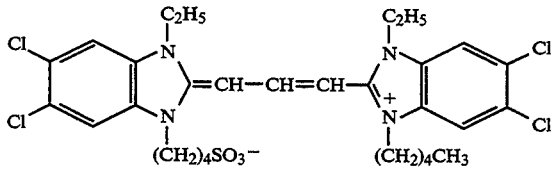

Selenium Compound I:

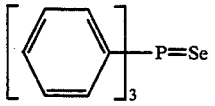

Preparation of Emulsion Layer Coating Liquid

The following additives were added to the chemically-sensitized emulsion to prepare a coating liquid (type A). The amount given below is per mol of silver halide.

| | |
|---|---|
| 2-Bis(hydroxyamino)-4-diethylamine-1,3,5-triazin | 72 mg |
| Trimethylolpropane | 9 g |
| Dextran (mean molecular weight 39,000) | 18.5 g |
| Potassium Polystyrenesulfonate (mean molecular weight 600,000) | 1.8 g |
| Compound (E-1) | 3.4 mg |
| Compound (E-2) | 4.8 g |
| Snowtex C (trade name of colloidal silica having a grain size of 10 to 20 mμ produced by Nissan Chemical Co.) | 29.1 g |
| Gelatin | 2.4 g/m² as the total amount on one surface |

-continued

| |
|---|
| Hardening Agent 1,2-Bis(vinylsulfonyl-acetamido)ethane to provide a swelling percentage of 230% |

Compound (E-1):

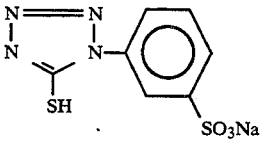

Compound (E-2):

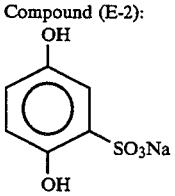

Preparation of Surface Protective Layer Coating Liquid

A coating liquid for forming a surface protective layer was prepared, comprising the following components.

| | |
|---|---|
| Gelatin | 0.966 g/m$^2$ |
| Sodium Polyacrylate (mean molecular weight 400,000) | 0.023 g/m$^2$ |
| Compound (P-1) | 0.013 g/m$^2$ |
| Compound (P-2) | 0.045 g/m$^2$ |
| Compound (P-3) | 0.0065 g/m$^2$ |
| Compound (P-4) | 0.003 g/m$^2$ |
| Compound (P-5) | 0.001 g/m$^2$ |
| Compound (P-6) | 0.0012 g/m$^2$ |
| Polymethyl Methacrylate (mean grain size 3.7 μm) | 0.087 g/m$^2$ |
| Proxel | 0.0005 g/m$^2$ |
| NaOH to make | pH of 7.4 |

Compound (P-1):

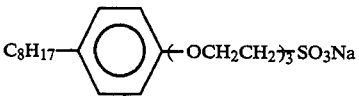

Compound (P-2):

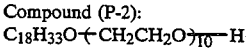

Compound (P-3):

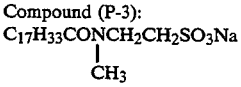

Compound (P-4):

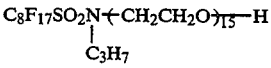

Compound (P-5):

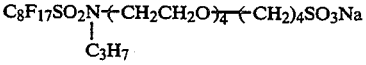

Compound (P-6):

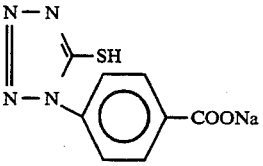

Preparation of Support (1) Preparation of Dye K for Subbing Layer

The following dye was treated by the ball-milling method as described in JP-A 63-197943.

Dye:

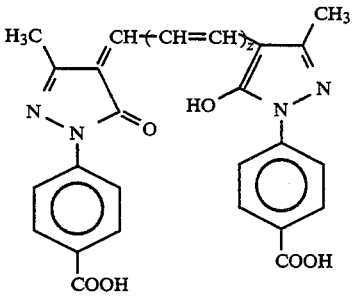

Particularly, 434 ml of water and 791 ml of an aqueous 6.7 wt % solution of Triton X-200 (registered trade name, surfactant produced by Rohm & Haas Co.) were placed in a 2-liter ball mill. 20 g of the dye was added to the solution. 400 ml of 2 mm-diameter zirconium oxide (ZrO) beads were added to the mill and the contents were milled for 4 days. Next, 160 g of 12.5 wt % gelatin was added thereto. After defoaming, ZrO beads were removed by filtration. The resulting dye dispersion was observed to have a broad grain size distribution (diameter) of from 0.05 to 1.15 μm, and a mean grain size of 0.37 μm.

The dispersion was subjected to centrifugation to remove large grains having a grain size of 0.9 μm or more. In this way, a dispersion of dye K was obtained.

(2) Preparation of Support:

A biaxially stretched 183 μm-thick polyethylene terephthalate film was treated by corona discharge, and 5.1 ml/m$^2$ of a first subbing layer coating liquid comprising the components listed below was coated on the support by a wire bar coater and dried at 175° C. for one minute.

The opposite surface .was also coated with the same first subbing layer coating liquid. The polyethylene terephthalate used contained 0.04% by weight of the following dye.

Dye:

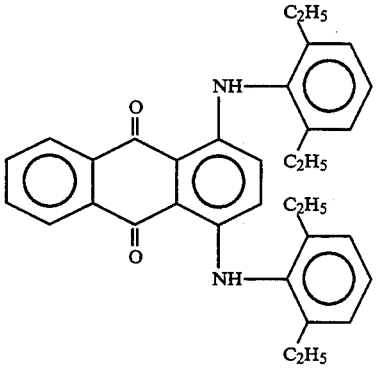

| First Subbing Layer Coating Liquid: | |
|---|---|
| Butadiene-Styrene Copolymer Latex Liquid (solid content 40 wt %; butadiene/styrene = 31/36, by weight) | 79 ml |

-continued

| First Subbing Layer Coating Liquid: | |
|---|---|
| 2,4-Dichloro-6-hydroxy-s-triazine Sodium Salt (4% solution) | 20.5 ml |
| Distilled Water | 900.5 ml |

The latex liquid contained 0.4% by weight of the following dispersing emulsifier.

Dispersing Emulsifier:

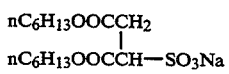

Both surfaces of the first subbing layer-coated support were coated with the following second subbing layer coating liquid by a bar coat method, one by one, by a wire bar coater system, and then dried at a temperature of 150° C. The amount of each component listed below is per each surface of the support.

| Second Subbing Layer Coating Liquid: | |
|---|---|
| Gelatin | 160 mg/m$^2$ |
| Dispersion of Dye K | 26 mg/m$^2$ (as solid dye content) |
| 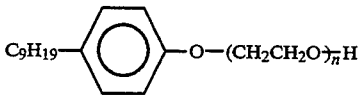 | (n = 8.5) 8 mg/m$^2$ |
| 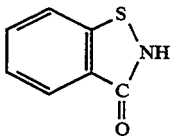 | 0.27 mg/m$^2$ |
| Matting Agent, Polymethyl Methacrylate of mean grain size of 2.5 μm | 2.5 mg/m$^2$ |

Preparation of Photographic Material Sample

On the both surfaces of the support thus prepared, the above-described emulsion layer and surface protective layer were coated by co-extrusion. The amount of silver coated was 1.75 g/m$^2$ per each surface. Thus, a photographic material sample was prepared.

The sample was processed using an automatic developing machine (CEPROS Model; manufactured by Fuji Photo Film Co. Ltd.) modified to have an accelerated film conveying speed.

Preparation of Processing Liquid Stock

| Developer: | |
|---|---|
| Part A: | |
| Potassium Hydroxide | 330 g |
| Potassium Sulfite | 630 g |
| Sodium Sulfite | 255 g |
| Potassium Carbonate | 90 g |
| Boric Acid | 45 g |
| Diethylene Glycol | 180 g |
| Diethylenetriamine-pentaacetic Acid | 30 g |
| 1-(N,N-diethylamino)ethyl-5-mercaptotetrazole | 0.75 g |
| Hydroquinone | 450 g |
| 4-Hydroxymethyl-4-methyl-1-phenyl-3-pyrazolidone | 60 g |
| Compound shown in Table 4 | 0.1 mol/l |

-continued

| | |
|---|---|
| Water to make | 4125 ml |
| Part B: | |
| Diethylene Glycol | 525 g |
| 3,3'-Dithiobishydrocinnamic Acid | 3 g |
| Glacial Acetic Acid | 102.6 g |
| 2-Nitroindazole | 3.75 g |
| 1-Phenyl-3-pyrazolidone | 34.5 g |
| Water to make | 750 ml |
| Part C: | |
| Glutaradehyde (50 wt/wt %) | 150 g |
| Potassium Bromide | 15 g |
| Potassium Metabisulfite | 105 g |
| Water to make | 750 ml |
| Fixer: | |
| Ammonium Thiosulfate (70 wt/vol %) | 3000 ml |
| Disodium Ethylenediaminetetraacetate Dihydrate | 0.45 g |
| Sodium Sulfite | 225 g |
| Boric Acid | 60 g |
| 1-(N,N-diethylamino)-ethyl-5-mercaptotetrazole | 15 g |
| Tartaric Acid | 48 g |
| Glacial Acetic Acid | 675 g |
| Sodium Hydroxide | 225 g |
| Sulfuric Acid (36 N) | 58.5 g |
| Aluminium Sulfate | 150 g |
| Water to make | 6000 ml |
| | pH 4.68 |

Preparation of Processing Solutions

The parts A, B and C of the concentrated developer stock were individually charged in respective stock containers. The stock containers for the parts A, B and C were in communication with one another.

The concentrated fixer stock was also charged in a container of the same kind.

300 ml of an aqueous starter solution containing 54 g of acetic acid and 55.5 g of potassium bromide was placed in a developer tank.

The respective stock containers each containing the stock part were set upside down and inserted into the boring edge of the processing liquid stock tank as disposed at the side wall of the automatic developing machine so that the sealant film of the cap of each container was broken. Thus, the respective stock parts were introduced into the stock tanks from their containers.

The individual stock parts were fed into the developer tank and fixer tank of the automatic developing machine, each in the amount indicated below, by driving the pumps as installed in the automatic developing machine.

After processing each batch of the photographic material sample in an amount of 8 quarter-size sheets, the processing liquid stocks were blended with water and replenished to the respective processing tanks of the developing machine.

| | |
|---|---|
| Developer: | |
| Part A Liquid | 55 ml |
| Part B Liquid | 10 ml |
| Part C Liquid | 10 ml |
| Water | 125 ml |
| pH | 10.50 |
| Fixer: | |
| Stock Liquid | 80 ml |
| Water | 120 ml |
| pH | 4.62 |

Tap water was filled in the rinsing tank.

As an anti-furring agent, 0.4 g of ray fungi carried on pearlite grains having a mean grain size of 100 μm and a mean pore size of 3 μm were filled in a polyethylene bottle, the mouth of which was covered with a 300-mesh nylon cloth. Water and fungi are able to move through the cloth. Three bottles each containing the fixed ray fungi were prepared. Two of them were set at the bottom of the washing tank, and one was at the bottom of the stock tank containing 0.2 liter of a rinsing stock therein.

| Processing Speed and Processing Temperature: | | |
|---|---|---|
| Development | 35° C. | 8.8 sec |
| Fixation | 32° C. | 7.7 sec |
| Rinsing with water | 17° C. | 3.8 sec |
| Squeezing | | 4.4 sec |
| Drying | 58° C. | 5.3 sec |
| Total | | 30 sec |
| Amount of Replenisher to Developer Tank | | 25 ml/10 × 12 inch |
| Amount of Replenisher to Fixer Tank | | 25 ml/10 × 12 inch |

Evaluation of Photographic Properties

As indicated above, the dry-to-dry processing time of the automatic developing machine was set to 30 seconds, and the photographic properties of the fresh developer were evaluated. Next, the developer was aged in the machine. Particularly, after a fresh developer was allowed to stand at a treating temperature for 12 hours a day for 3 weeks, the photographic properties of the aged developer were again evaluated in the same manner.

First, both surfaces of the photographic material samples prepared as described above were exposed to light for 0.05 second, using an X-ray ortho-screen HR-4Model (Manufactured by Fuji Photo Film Co.). After exposure, the exposed samples were processed in the manner described above, and the sensitivity of the processed sample was obtained. The gradation of the processed sample was represented as a value obtained by dividing the difference between the density of (fog+0.25) and the density of (fog+2.0) by the difference between the logarithmic exposure amounts each providing the respective densities. The sensitivity was represented relative to the sensitivity of the sample (taken as 100) processed with the fresh control developer (not containing the additive compound), indicating the reciprocal of the exposure amount needed for obtaining a density of (fog+1.0). Dm indicates the maximum density.

The results of the photographic properties thus obtained are shown in Table 4 below.

| No. | Compound Added to Developer | Developer | Photographic Properties sensitivity | gradation | Fog | Dm | |
|---|---|---|---|---|---|---|---|
| 1 | Control (none added) | fresh developer | 100 | 3.0 | 0.15 | 3.5 | comparative |
| | | aged developer | 60 | 2.6 | 0.16 | 3.4 | example |
| 2 | Compound A-4 | fresh developer | 98 | 3.0 | 0.15 | 3.5 | example of |
| | | aged developer | 88 | 2.9 | 0.15 | 3.5 | the invention |
| 3 | Compound A-52 | fresh developer | 98 | 3.0 | 0.15 | 3.5 | example of |
| | | aged developer | 91 | 3.0 | 0.15 | 3.4 | the invention |
| 4 | Compound B-27 | fresh developer | 102 | 3.0 | 0.15 | 3.5 | example of |
| | | aged developer | 93 | 2.9 | 0.16 | 3.5 | the invention |
| 5 | Compound B-37 | fresh developer | 101 | 3.0 | 0.15 | 3.5 | example of |
| | | aged developer | 90 | 3.0 | 0.15 | 3.5 | the invention |

As shown by Table 4 above, the developer containing the compound of the present invention did not increase fogging of the photographic material samples, yet provided a sufficient Dm density. Even after storage, the developer containing the compound of the present invention maintained high sensitivity and high contrast of the samples processed therewith. These results well support the effects of the present invention.

EXAMPLE 4

Preparation of Silver Halide Emulsion:

34 g of gelatin was added to 850 ml of water in a container at 65° C., and 1.7 g of sodium chloride, 0.1 g of potassium bromide and 70 mg of the following compound A:

$$HO-(CH_2)_2-S-(CH_2)_2-S-(CH_2)_2-OH$$

were added thereto. Then, 500 ml of an aqueous solution containing 170 g of silver nitrate and 500 ml of an aqueous solution containing potassium hexachloroiridate(III) in an amount of $5\times10^{-7}$ mol as iridium, per mol of silver halide formed, and containing 12 g of sodium chloride and 98 g of potassium bromide were added thereto by a double jet method to prepare monodispersed cubic silver chlorobromide grains having a mean grain size of 0.4 μm. The emulsion was de-salted, and then 50 g of gelatin was added thereto. The emulsion was adjusted to a pH of 6.5 and a pAg of 8.1, and 2.5 mg of sodium thiosulfate and 5 mg of chloroauric acid were added thereto for chemical sensitization at 60° C. Then, 0.2 g of 4-hydroxy-6-methyl-1,3,3a,7-tetrazaindene was added thereto, and the emulsion was rapidly solidified to prepare emulsion A.

Next, monodispersed cubic silver chlorobromide grains having a grain size of 0.3 μm were prepared in the same manner as emulsion A, except that the gelatin solution was heated to 40° C. After desalting, 50 g of gelatin was added thereto. The emulsion was adjusted to a pH of 6.5 and pAg a of 8.1. To this were added 2.5 mg of sodium thiosulfate and 5 mg of chloroauric acid for chemical sensitization at 65° C. Then, 0.2 g of 4-hydroxy-6-methyl-1,3,3a,7-tetrazaindene was added thereto and rapidly solidified to prepare emulsion B.

Emulsion A and emulsion B were blended in a ratio of 1/1 by weight, and the following additives were added to the blended emulsion. The amount of each compound was per mol of silver halide. Thus, an emulsion coating liquid was prepared.

| Formulation of Emulsion Coating Liquid: | |
|---|---|
| Spectral Sensitizing Dye (2) | $1.0\times10^{-4}$ mol |
| Super Spectral Sensitizer (3) | $0.7\times10^{-3}$ mol |
| Storage Stability Improving Agent (4) | $1\times10^{-3}$ mol |
| Polyacrylamide (molecular weight 40,000) | 10 g |
| Dextran | 10 g |
| Trimethylolpropane | 1.6 g |
| Sodium Polystyrenesulfonate | 1.2 g |
| Latex of Poly(ethyl acrylate/methacrylic acid) | 12 g (as solid) |

-continued

| | |
|---|---|
| N,N'-Ethylenebis-(vinylsulfonacetamide) | 3.0 g |
| 1-Phenyl-5-mercaptotetrazole | 50 mg |
| Stabilizer (9) | 100 mg |

Spectral Sensitizing Dye (2):

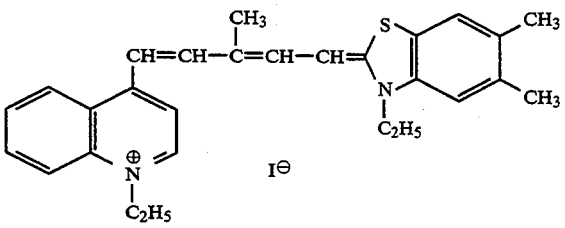

Super Spectral Sensitizer (3):

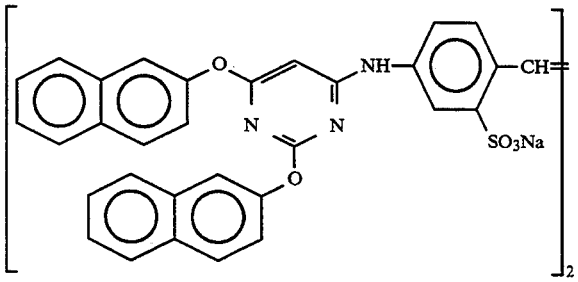

Storage Stability Improving Agent (4):

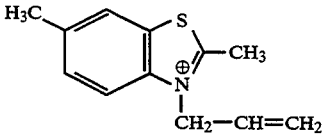

Stabilizer (9):

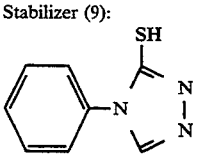

Preparation of Coating Liquid of Protective Layer for Emulsion Layer

The following chemicals were blended in a container at 40° C. to prepare a coating liquid.

| Formulation of Coating Liquid of Protective Layer for Emulsion Layer: | |
|---|---|
| Gelatin | 100 g |
| Polyacrylamide (molecular weight 40,000) | 12 g |
| Sodium Polystyrenesulfonate (molecular weight 600,000) | 0.6 g |
| N,N'-Ethylenebis-(vinylsulfonacetamide) | 2.2 g |
| Fine Grains of Polymethyl Methacrylate (mean grain size 2.0 μm) | 2.7 g |
| Sodium t-octylphenoxyethoxyethanesulfonate | 1.8 g |
| $C_{16}H_{33}O—(CH_2CH_2O)_{10}—H$ | 4.0 g |
| Sodium Polyacrylate | 6.0 g |
| $C_8F_{17}SO_3K$ | 70 mg |
| $C_8F_{17}SO_2N(C_3H_7)(CH_2CH_2O)(CH_2)_4—SO_3Na$ | 70 mg |
| NaOH (1 N) | 6 ml |
| Methanol | 90 ml |
| 1-Phenyl-5-mercaptotetrazole | 80 mg |
| Compound (5) | 0.06 g |

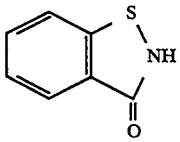

Preparation of Backing Layer Coating Liquid

The following chemicals were blended in a container at 40° C. to obtain a coating liquid for the backing layer.

| Formulation of Coating Liquid of Backing Layer: | |
|---|---|
| Gelatin | 100 g |
| Dye (6) | 4.2 g |
| Sodium Polystyrenesulfonate | 1.2 g |
| Latex of Poly(ethyl acrylate/methacrylic acid) | 5 g |
| N,N'-ethylenebis-(vinylsulfonacetamide) | 4.8 g |
| Compound (5) | 0.06 g |
| Dye (7) | 0.3 g |
| Dye (8) | 0.05 g |
| Colloidal Silica | 15 g |

Dye (6):

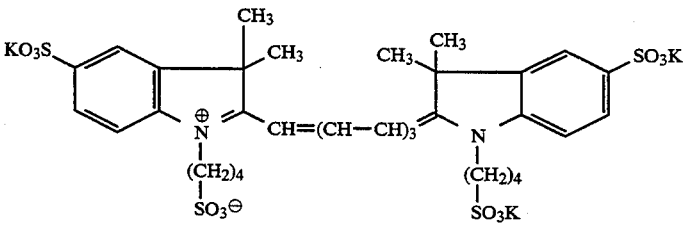

Dye (7):

-continued

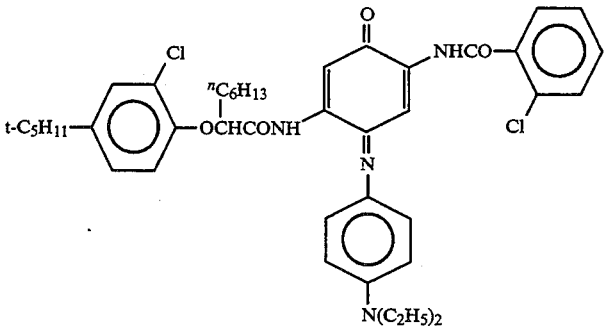

Dye (8):

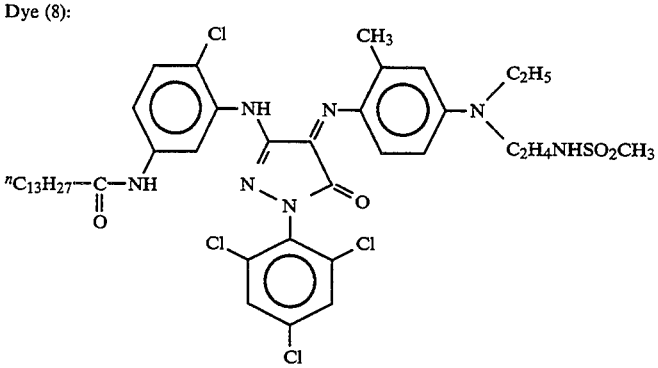

Preparation of Coating Liquid of Protective Layer for Backing Layer

The following chemicals were blended in a container at 40° C. to prepare a coating liquid.

| Formulation of Coating Liquid of Protective Layer for Backing Layer: | |
|---|---|
| Gelatin | 100 g |
| Sodium Polystyrenesulfonate | 0.5 g |
| N,N'-ethylenebis-(vinylsulfonacetamide) | 1.9 g |
| Fine Grains of Polymethyl Methacrylate (mean grain size 4.0 μm) | 4 g |
| Sodium T-octylphenoxyethoxyethanesulfonate | 2.0 g |
| NaOH (1 N) | 6 ml |
| Sodium Polyacrylate | 2.4 g |
| $C_{16}H_{33}O—(CH_2CH_2O)_{10}—H$ | 4.0 g |
| $C_8F_{17}SO_2N(C_3H_7)(CH_2CH_2O)(CH_2)_4—SO_3Na$ | 70 mg |
| Methanol | 150 ml |
| Compound (5) | 0.06 g |

Formation of Photographic Material Sample:

The above-described backing layer coating liquid was coated onto one surface of a polyethylene terephthalate support together with the above-described surface protective layer coating liquid, the total gelatin amount coated being 3.0 g/m$^2$.

Next, the above-described emulsion layer coating liquid was coated on the opposite surface of the support together with the above-described surface protective layer, the total coated silver amount being 2.3 g/m$^2$ and the coated gelatin amount in the surface protective layer being 1.0 g/m$^2$. Thus, a coated sample was prepared. The sensitivity of the individual emulsion was measured on the basis of the sensitometric method described below.

Processing solutions used for processing the sample are given below.

| Composition of Developer: | |
|---|---|
| KOH | 57.5 g |
| $Na_2SO_3$ | 87.5 g |
| $K_2SO_3$ | 110 g |
| Diethylenetriaminepentaacetic Acid | 5 g |
| Boric Acid | 25 g |
| $K_2CO_3$ | 32.5 g |
| Hydroquinone | 87.5 g |
| Diethylene Glycol | 125 g |
| 4-Hydroxymethyl-4-methyl-1-phenyl-3-pyrazolidone | 10 g |
| 5-Methylbenzotriazole | 0.15 g |
| 2,3,5,6,7,8-Hexahydro-2-thioxo-4(1H)quinazoline | 0.25 g |
| Sodium 2-Mercaptobenzimidazole-5-sulfonate | 0.35 g |
| KBr | 7.5 g |
| 1-Phenyl-5-mercapto-tetrazole | 0.15 g |
| Compound shown in Table 5 | 0.1 mol/l |
| Water to make | 2.5 liters |
| Composition of Fixer: | |
| Ammonium Thiosulfate | 145 g |
| Disodium Ethylenediaminetetraacetate Dihydrate | 30 mg |
| $Na_2S_2O_3.5H_2O$ | 15 g |
| Sodium Metabisulfite | 13.3 g |
| NaOH | 12.6 g |
| Acetic Acid (90 wt. %) | 30 g |
| KI | 0.5 g |
| Water to make | 1 liter |

Evaluation of Photographic Properties

The photographic material samples formed as above were subjected to sensitometry in accordance with the method given below to determine sensitivity and gamma. Particularly, after coating, the material was stored at 25° C. and 60% RH for 7 days, and then subjected to scanning exposure with a semiconductor laser of 780 nm (FCR7000 Laser Image Printer Type CR-LP414, manufactured by Fuji Photo Film Co.). The exposed samples were then processed with a model FCR7000 automatic developing machine (manufactured by Fuji Photo Film Co.) at a development temperature of 35° C. and a film conveying speed of 1400 mm/min. modified to provide a dry-to-dry processing time of 30 seconds.

The photographic properties of the fresh developer were first evaluated in the manner described below. Next, a fresh developer was aged in the automatic developing machine by incubating therein for 12 hours a day. After 3 weeks of incubation at the developing temperature, the photographic properties of the thus aged and fatigued developer were also evaluated.

The gradation is represented as a value obtained by dividing the difference between the density of (fog+0.8) and the density of (fog+2.0) by the difference between the logarithmic exposure amounts providing the respective densities. The sensitivity is represented relative to the sensitivity of the sample (taken as 100) processed with the fresh control developer (not containing the additive compound), indicating the reciprocal of the exposure amount needed for obtaining a density of (fog+1.0).

The evaluation results of the photographic properties for both the fresh developer and the aged developer are shown in Table 5 below.

TABLE 5

| No. | Compound Added to Developer | Developer | Photographic Properties sensitivity | gradation | |
|---|---|---|---|---|---|
| 1 | Control (none added) | fresh developer | 100 | 2.5 | comparative example |
| | | aged developer | 77 | 1.8 | |
| 2 | Compound A-5 | fresh developer | 100 | 2.5 | example of the invention |
| | | aged developer | 92 | 2.3 | |
| 3 | Compound A-23 | fresh developer | 101 | 2.5 | example of the invention |
| | | aged developer | 88 | 2.2 | |
| 4 | Compound A-53 | fresh developer | 102 | 2.5 | example of the invention |
| | | aged developer | 90 | 2.1 | |
| 5 | Compound B-67 | fresh developer | 100 | 2.5 | example of the invention |
| | | aged developer | 85 | 2.2 | |

As shown by Table 5 above, the developer containing the compound of the present invention even after having been aged and fatigued still provided high sensitivity and high contrast of the samples processed therewith. These results well support the effects of the present invention.

As discussed in detail above, the stability of a black-and-white developer to aerial oxidation is noticeably improved by addition of the compound of the present invention thereto. Furthermore, the amount of replenisher to the developer may be reduced as well as the environmental pollution load due to waste liquid from the photographic process. Stable and high-quality images may be formed by the method of the present invention.

While the invention has been described in detail and with reference to specific embodiments thereof, it will be apparent to one skilled in the art that various changes and modifications can be made therein without departing from the spirit and scope thereof.

What is claimed is:

1. A method of processing an imagewise exposed silver halide photographic material comprising a support having thereon at least one light-sensitive silver halide emulsion layer, comprising developing in a developing bath and fixing in a fixing bath, wherein the developing bath contains developer containing at least one compound represented by formulae (A) and (B):

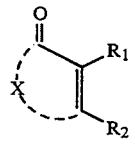

(A)

where $R_1$ and $R_2$ each represent a hydroxyl group, a substituted or unsubstituted amino group, an acylamino group, an alkylsulfonylamino group, an arylsulfonylamino group, an alkoxycarbonylamino group, a mercapto group or an alkylthio group; and X represents a group of atoms selected from carbon and nitrogen which forms a 5-membered or 6-membered ring together with the two vinyl carbons substituted by $R_1$ and $R_2$, respectively, and the carbonyl carbon of formula (A);

(B)

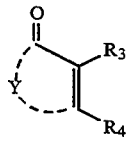

where $R_3$ and $R_4$ each represent a hydroxyl group, a substituted or unsubstituted amino group, an acylamino group, an alkylsulfonylamino group, an arylsulfonylamino group, an alkoxycarbonylamino group, a mercapto group or an alkylthio group; and Y represents a group of atoms selected from carbon, nitrogen and oxygen containing at least one

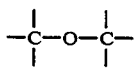

bond, and

Y forms a 6-membered ring together with the two vinyl carbons substituted by $R_3$ and $R_4$, respectively, and the carbonyl carbon of formula (B), provided that both $R_3$ and $R_4$ are not hydroxyl groups, and when $R_1$, $R_2$, $R_3$ or $R_4$ represents an amino group, the compound may be in the form of an acid addition salt.

2. The method of claim 1, wherein X represents a group containing at least two of $-C(R_5)(R_6)-$, $-C(R_7)=$, $-C(=O)-$, $-N(R_8)-$ and $-N=$, wherein $R_5$, $R_6$, $R_7$ and $R_8$ each represents a hydrogen atom, a substituted or unsubstituted alkyl group having from 1 to 10 carbon atoms, a substituted or unsubstituted aryl group having from 6 to 15 carbon atoms, a hydroxyl group, —COOM or —$SO_3M$ (wherein M represents a hydrogen atom, an alkali metal atom, or —$NH_4$).

3. The method of claim 1, wherein the 5-membered or 6-membered ring of formula (A) is selected from the group consisting of a cyclopentenone ring, a cyclohexenone ring, a pyrrolinone ring, a pyrazolinone ring, a pyridone ring, an azacyclohexanone ring and a uracil ring.

4. The method of claim 1, wherein Y comprises one or two of —$C(R_5)(R_6)$—, —$C(R_7)$=, —C(=O)—, —$N(R_8)$— and —N=, and at least one —O— bond, wherein $R_5$, $R_6$, $R_7$ and $R_8$ each represents a hydrogen atom, a substituted or unsubstituted alkyl group having from 1 to 10 carbon atoms, a substituted or unsubstituted aryl group having from 6 to 15 carbon atoms, a hydroxyl group, —COOM or —$SO_3M$ (wherein M represents a hydrogen atom, an alkali metal atom, or —$NH_4$ ).

5. The method of claim 1, wherein the 5-membered or 6-membered ring of formula (B) is selected from the group consisting of a dihydropyrrone ring and pyranone ring.

6. The method of claim 1, wherein the developer contains at least one compound represented by formulae (A) and (B) in an amount of from 0.1 to 50 g per liter.

7. The method of claim 1, wherein the developer contains a dihydroxybenzene developing agent.

8. The method of claim 1, wherein the developing bath comprises a dihydroxybenzene developing agent in an amount of from 0.01 to 1.5 mol/l.

9. The method of claim 1, wherein the developer contains a sulfite in an amount at least 0.1 mol/liter.

10. The method of claim 1, wherein the developing bath contains sulfite in an amount of up to 2.5 mol/liter.

11. The method of claim 7, wherein the developer contains at least one of a 1-phenyl-3-pyrrazolidone developing agent and an aminophenol developing agent.

12. The method as in claim 1, wherein the pH of the developer is within the range of from 9 to 13.

* * * * *